US008837982B2

(12) United States Patent
Matsuda

(10) Patent No.: US 8,837,982 B2
(45) Date of Patent: Sep. 16, 2014

(54) ELECTROPHOTOGRAPHIC IMAGE FORMING APPARATUS

(75) Inventor: Kenji Matsuda, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 219 days.

(21) Appl. No.: 13/230,038

(22) Filed: Sep. 12, 2011

(65) Prior Publication Data

US 2012/0063808 A1 Mar. 15, 2012

(30) Foreign Application Priority Data

Sep. 14, 2010 (JP) ..... 2010-205269

(51) Int. Cl.
*G03G 21/16* (2006.01)

(52) U.S. Cl.
CPC ..... *G03G 21/1647* (2013.01); *G03G 2221/163* (2013.01); *G03G 2215/0132* (2013.01); *G03G 2221/1684* (2013.01)
USPC ..... 399/111; 399/119

(58) Field of Classification Search
USPC ..... 399/110, 111, 113, 116, 117, 119
See application file for complete search history.

(56) References Cited

U.S. PATENT DOCUMENTS

2003/0161656 A1* 8/2003 Miura et al. ..... 399/116
2009/0028602 A1* 1/2009 Kamimura et al. ..... 399/113
2010/0080624 A1* 4/2010 Matsuda ..... 399/119

FOREIGN PATENT DOCUMENTS

JP 3968301 B2 8/2007

* cited by examiner

*Primary Examiner* — David Gray
*Assistant Examiner* — Thomas Giampaolo, II
(74) *Attorney, Agent, or Firm* — Fitzpatrick, Cella, Harper & Scinto

(57) ABSTRACT

An image forming apparatus includes a drum cartridge supporting member supporting a plurality of drum cartridges having photosensitive drums. The drum cartridge supporting member is movable between first and second positions inside and outside a main assembly of the image forming apparatus. A guide portion guides a plurality of developing cartridges having developing rollers for developing electrostatic latent images formed on the corresponding photosensitive drums. The guide portion individually guides the developing cartridges to and from the main assembly. A moving mechanism moves the developing cartridges mounted in the main assembly between a developing position in which the electrostatic latent images are to be developed and a retracted position in which the developing cartridges are retracted from the developing position. When the developing cartridges are in the retracted position, the drum cartridge supporting member is permitted to move between the first and second positions.

8 Claims, 19 Drawing Sheets

(a)

(b)

(a)

(b)

(a)

(b)

ELECTROPHOTOGRAPHIC IMAGE FORMING APPARATUS

FIELD OF THE INVENTION AND RELATED ART

The present invention relates to an electrophotographic image forming apparatus using an electrophotographic image forming method. Here, the electrophotographic image forming apparatus forms a color image on a recording material (medium) by using an electrophotographic image forming process. Examples of the electrophotographic image forming apparatus include an electrophotographic copying machine, an electrophotographic printer (such as a color laser beam printer or a color LED printer), a facsimile machine and the like. On the recording material, the image is formed by the electrophotographic image forming apparatus and examples of the recording material include paper, OHP sheet and the like.

A color electrophotographic image forming apparatus for forming the color image on the recording material has been conventionally known.

In such an image forming apparatus, a plurality of electrophotographic photosensitive drums are juxtaposed inside an apparatus main assembly. As a result, electrostatic latent images formed on the respective photosensitive drums are developed with developers of different colors. The type in which the plurality of photosensitive drums are juxtaposed is generally referred to as a tandem type.

The photosensitive drum and a developing roller are consumables which are consumed as an image forming operation is performed. Therefore, these members are replaced when they reach their predetermined lifetimes. In this case, a method has been known in which the photosensitive drum and a process means acting on the photosensitive drum, such as a charging means, are integrally assembled with a frame for supporting these members into a drum cartridge. Similarly, a method has been known in which the developing roller, the developer and developer accommodating portion for accommodating the developer are integrally assembled with a frame for supporting these members into a developing cartridge. The consumables are assembled into the cartridge such as the drum cartridge or the developing cartridge, so that it becomes possible to improve an exchanging (replacing) operation property of the consumables.

As an exchanging method of such consumables for the image forming apparatus, the following method has been known.

The photosensitive drum is supported by a drum cartridge supporting member and the drum cartridge supporting member is pulled out in an axial (shaft) direction of the photosensitive drum and then a photosensitive drum exchanging operation is performed from above the drum cartridge supporting member. Similarly, the developing cartridge is supported by a developing supporting member and the developing cartridge supporting member is pulled out in an axial direction of the developing roller and then a developing cartridge exchanging operation is performed from above the developing cartridge supporting member (Japanese Patent No. 3968301). In this method, the photosensitive drum is mounted from above the drum cartridge supporting member and therefore positioning of the photosensitive drum relative to the drum cartridge supporting member can be effected by a simple constitution.

SUMMARY OF THE INVENTION

The present invention provides a further development of the above-described conventional constitution.

A principal object of the present invention is to provide an electrophotographic image forming apparatus, having a constitution including a drum cartridge supporting member for supporting a plurality of drum cartridges, capable of facilitating individual exchange of a developing cartridge, of a plurality of developing cartridges, having a high possibility of the individual exchange.

In the case where the plurality of drum cartridges and the plurality of developing cartridges are mounted in an apparatus main assembly, the individual drum cartridge is demounted after the drum cartridge supporting member is pulled out. Another object of the present invention is to provide an electrophotographic image forming apparatus in which the individual developing cartridge is directly demounted from the apparatus main assembly.

According to an aspect of the present invention, there is provided an image forming apparatus for forming an image on a recording material, comprising:

a drum cartridge supporting member for supporting a plurality of drum cartridges each including an electrophotographic photosensitive drum, wherein the drum cartridge supporting member is movable, with respect to an axial direction of the electrophotographic photosensitive drum, between a first position inside a main assembly of the image forming apparatus and a second position, outside the main assembly, in which the drum cartridges are mountable and dismountable;

a guide portion for guiding a plurality of developing cartridges each including a developing roller for developing an electrostatic latent image formed on the electrophotographic photosensitive drum, wherein the guide portion individually guides the developing cartridges mountably to and demountably from the main assembly in an axial direction of the developing roller; and moving means for moving the developing cartridge mounted in the main assembly between a developing position in which the electrostatic latent image is to be developed and a retracted position in which the developing cartridge is retracted from the developing position, wherein when the developing cartridge is in the retracted position, the drum cartridge supporting member is permitted to move between the first position and the second position.

These and other objects, features and advantages of the present invention will become more apparent upon a consideration of the following description of the preferred embodiments of the present invention taken in conjunction with the accompanying drawings.

Figure 2:
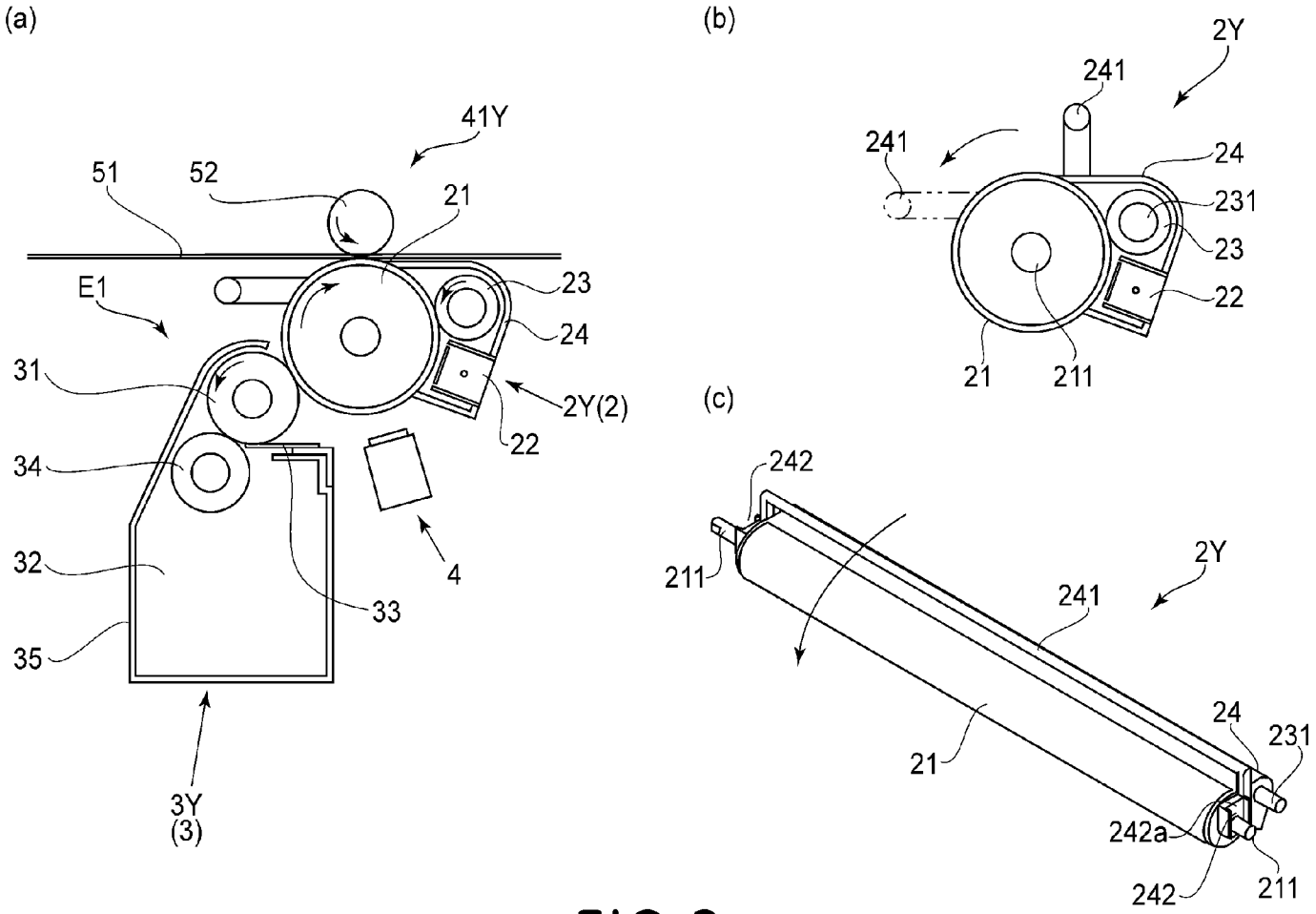

Parts (a) and (b) of FIG. 2 are enlarged schematic views showing a structure of an image forming portion, and part (c) of FIG. 2 is an enlarged perspective view showing the structure of the image forming portion.

Figure 3:
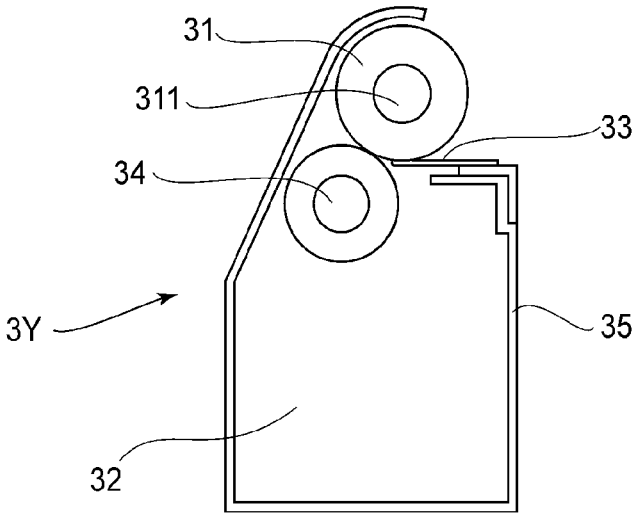
Figure 3:
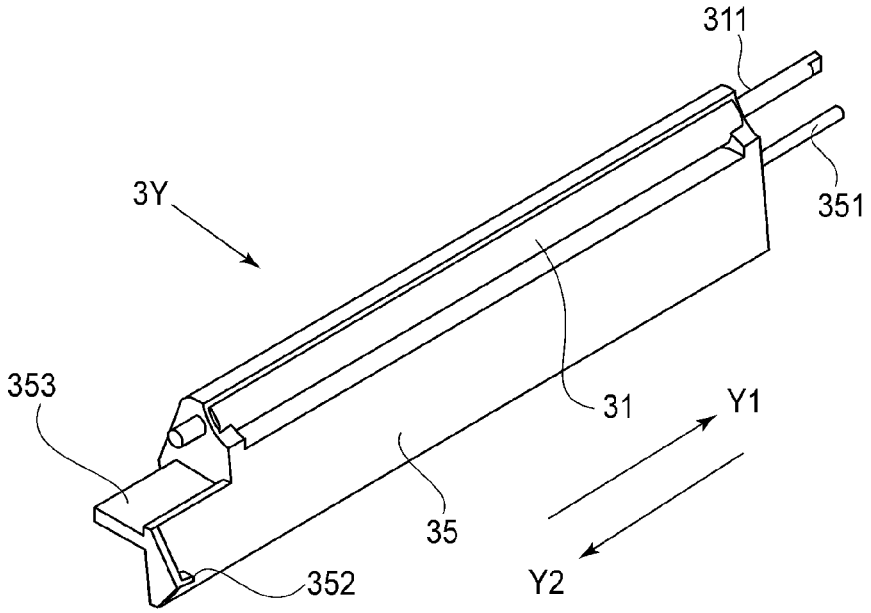

Parts (a) and (b) of FIG. 3 are a sectional view and a perspective view, respectively, showing a structure of a cartridge.

Figure 4:
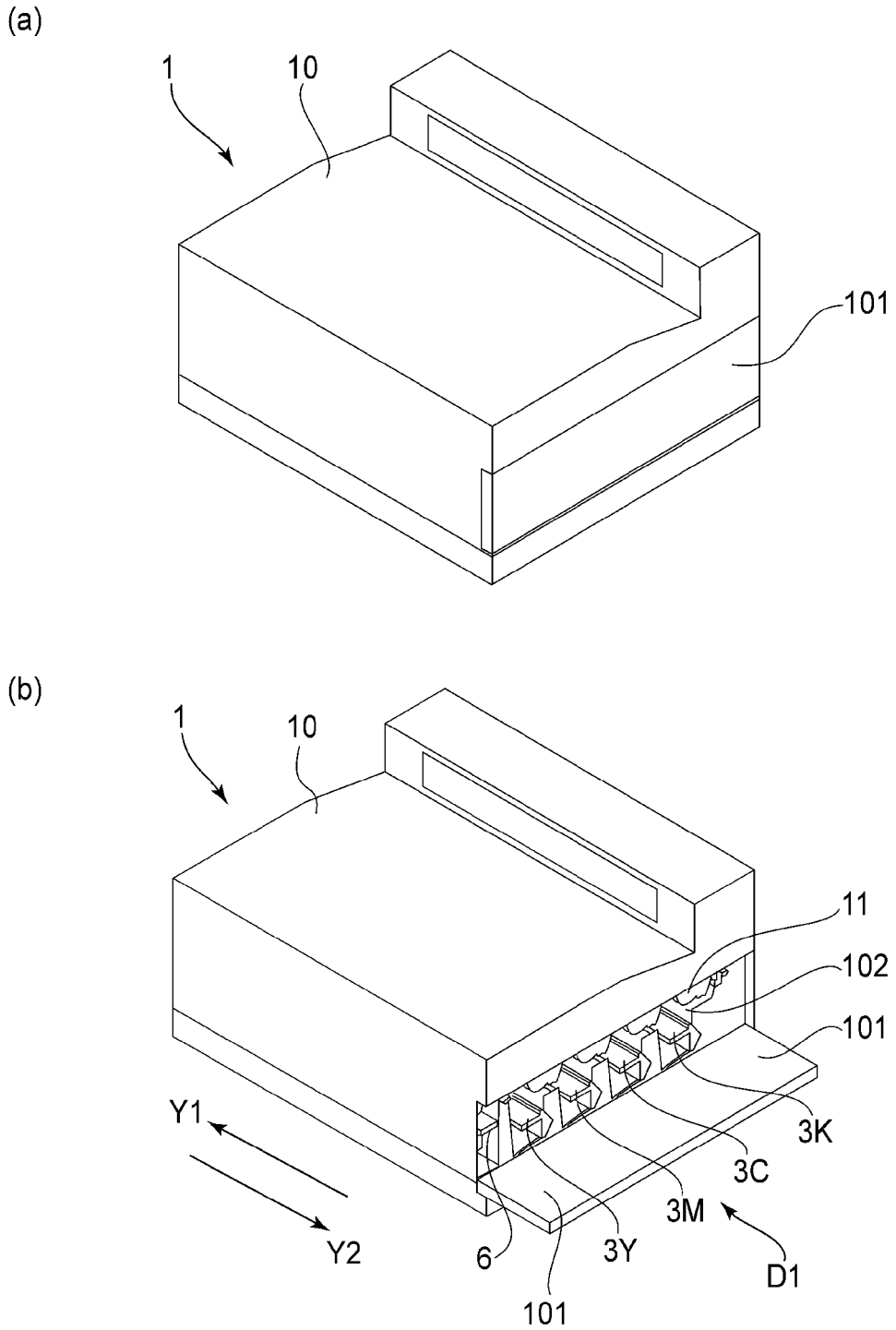

Parts (a) and (b) of FIG. 4 are perspective views showing the structure of the image forming apparatus, in which (a) shows a state in which a cover is closed and (b) shows a state in which the cover is open.

Figure 5:
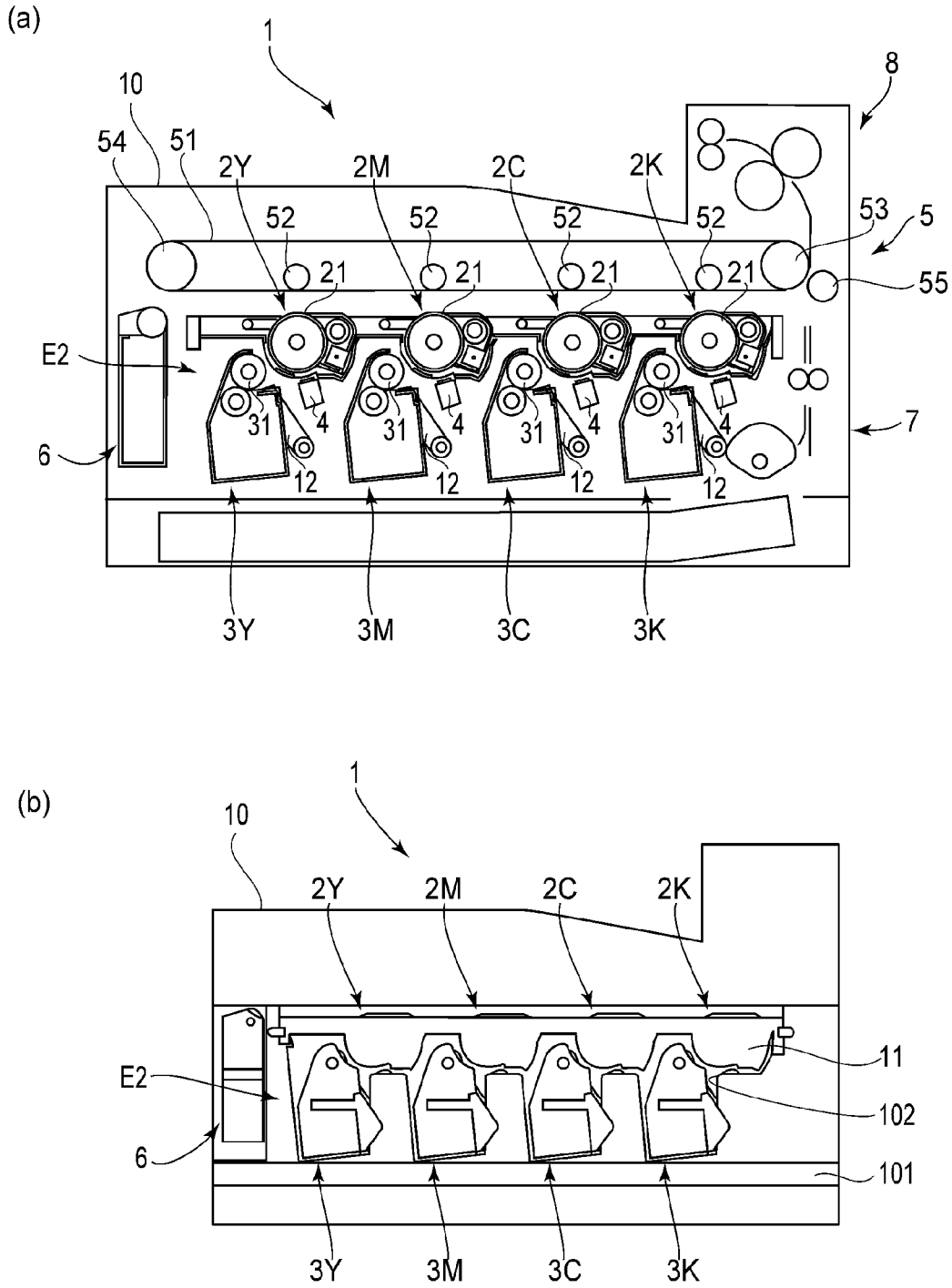

Parts (a) and (b) of FIG. 5 are sectional views showing the structure of the image forming apparatus.

Figure 6:
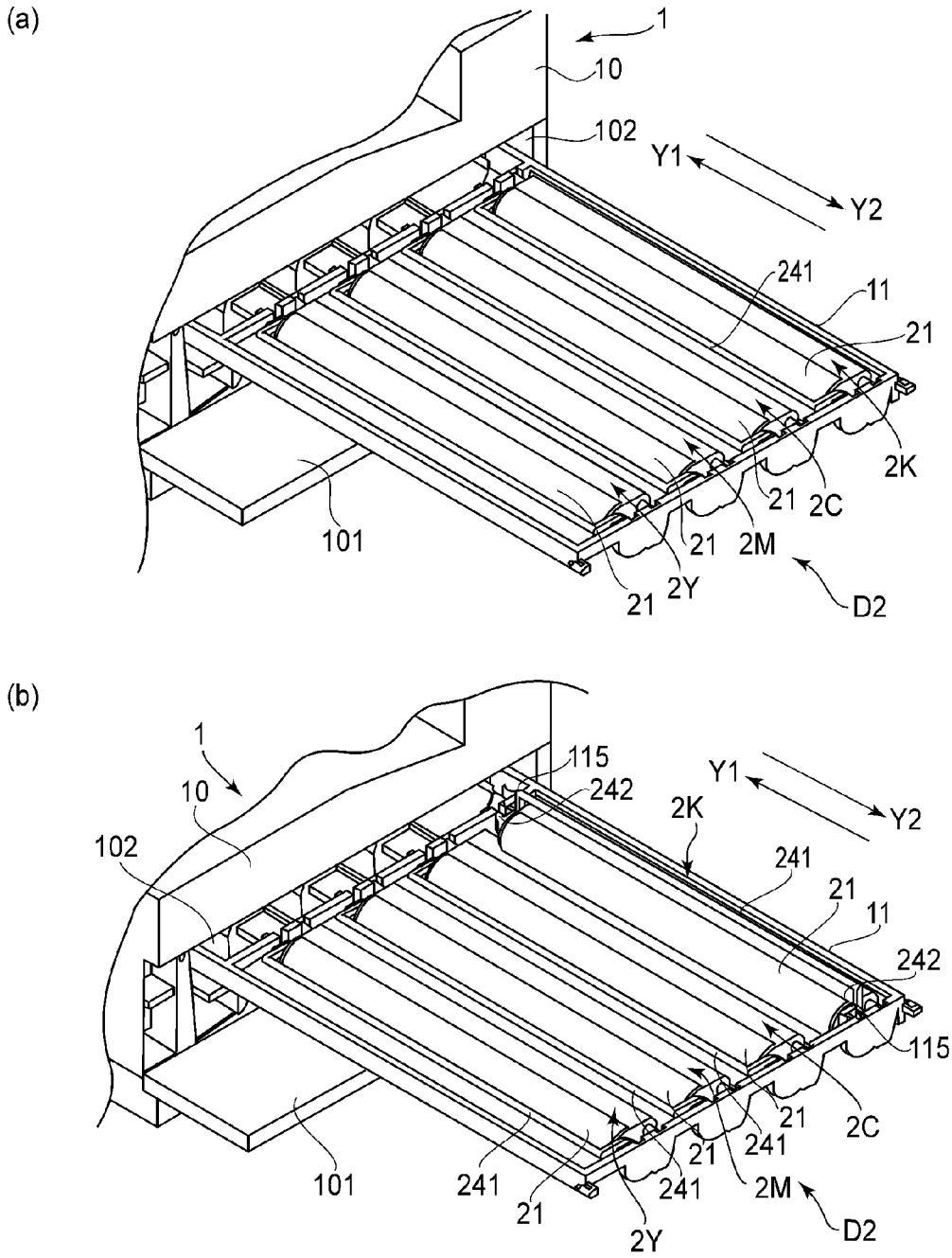

Parts (a) and (b) of FIG. 6 are perspective views showing the structure of the image forming apparatus from which a unit is pulled out at a front side.

Figure 7:
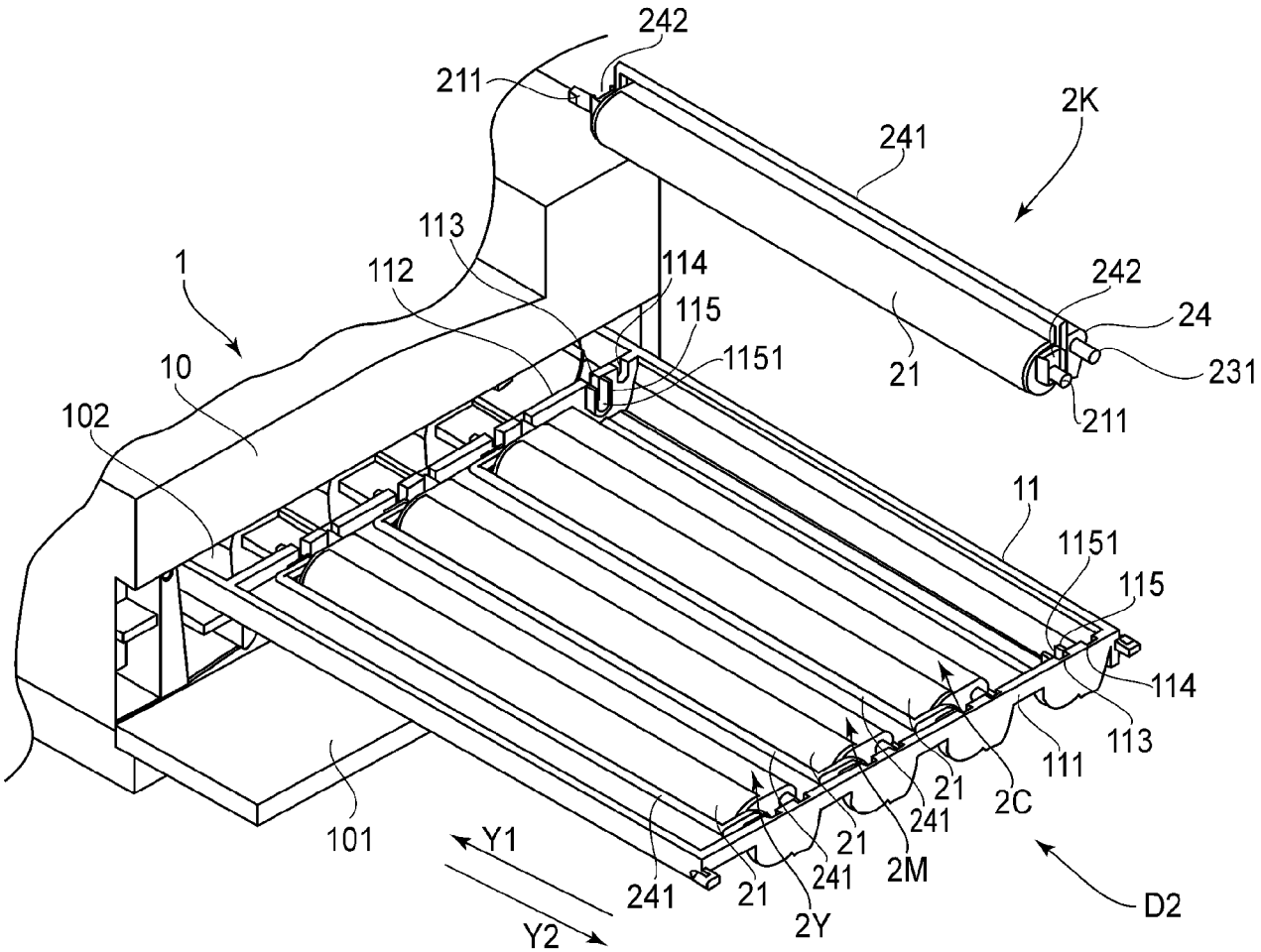

FIG. 7 is a perspective view showing the structure of the image forming apparatus including the unit from which one of cartridges is demounted.

Figure 8:
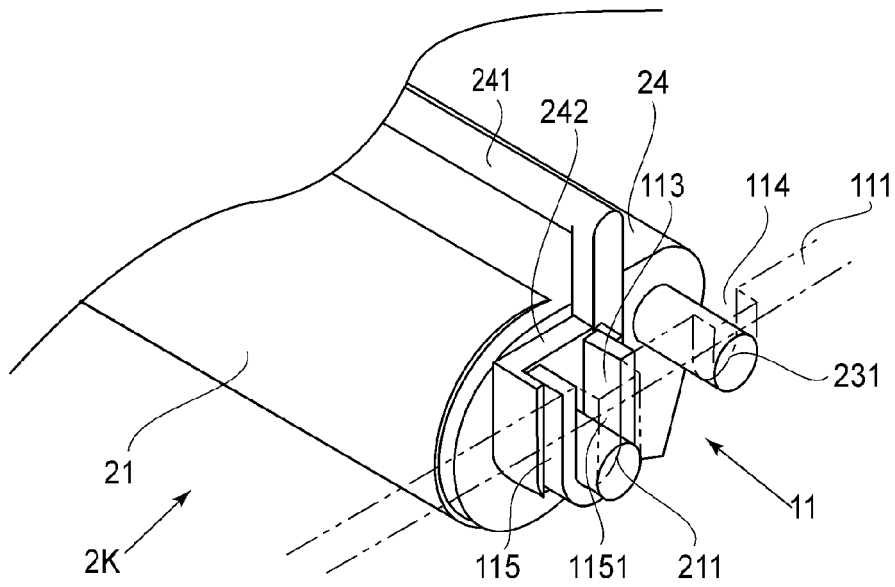
Figure 8:
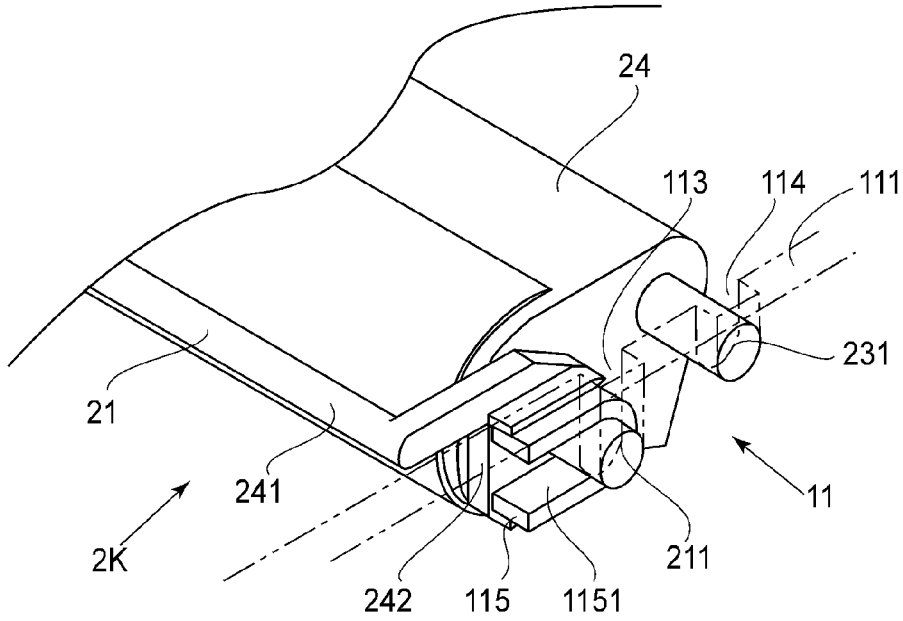

Parts (a) and (b) of FIG. 8 are partly enlarged views showing a structure of the unit.

Figure 9:
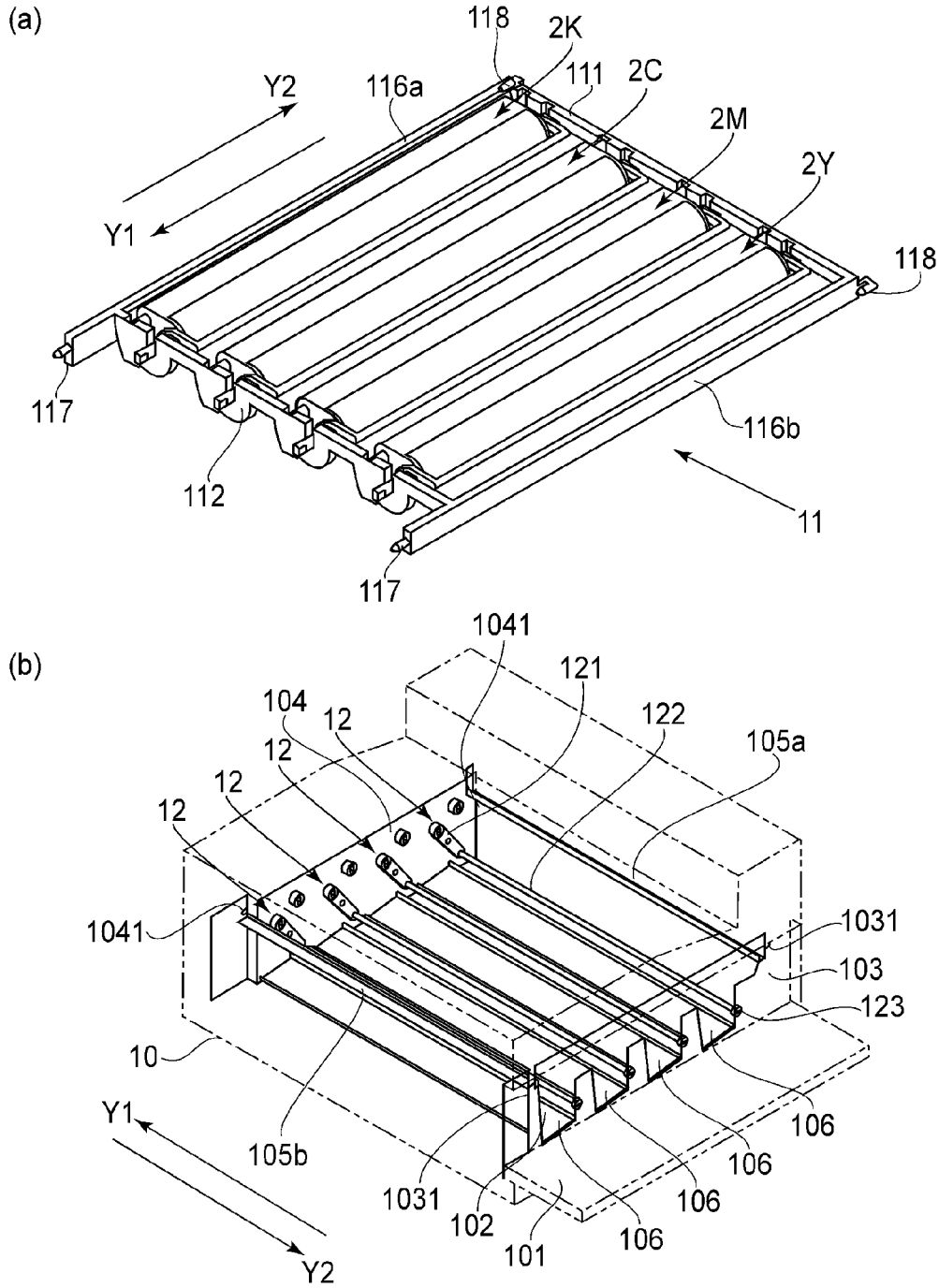

Parts (a) and (b) of FIG. 9 are perspective views of the unit in which the drum cartridge is mounted.

Figure 10:
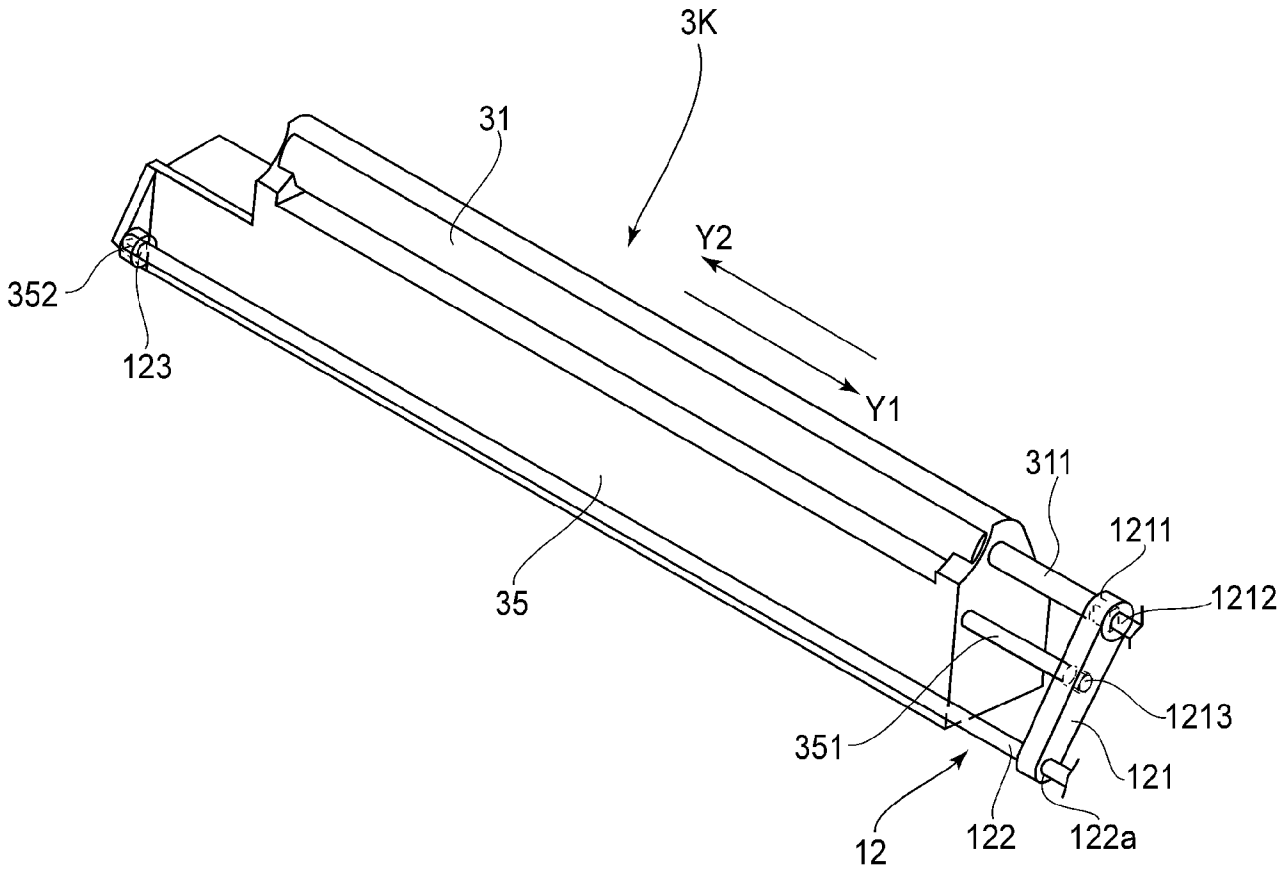

FIG. 10 is a perspective view showing a state in which a moving mechanism supports the cartridge.

Figure 11:
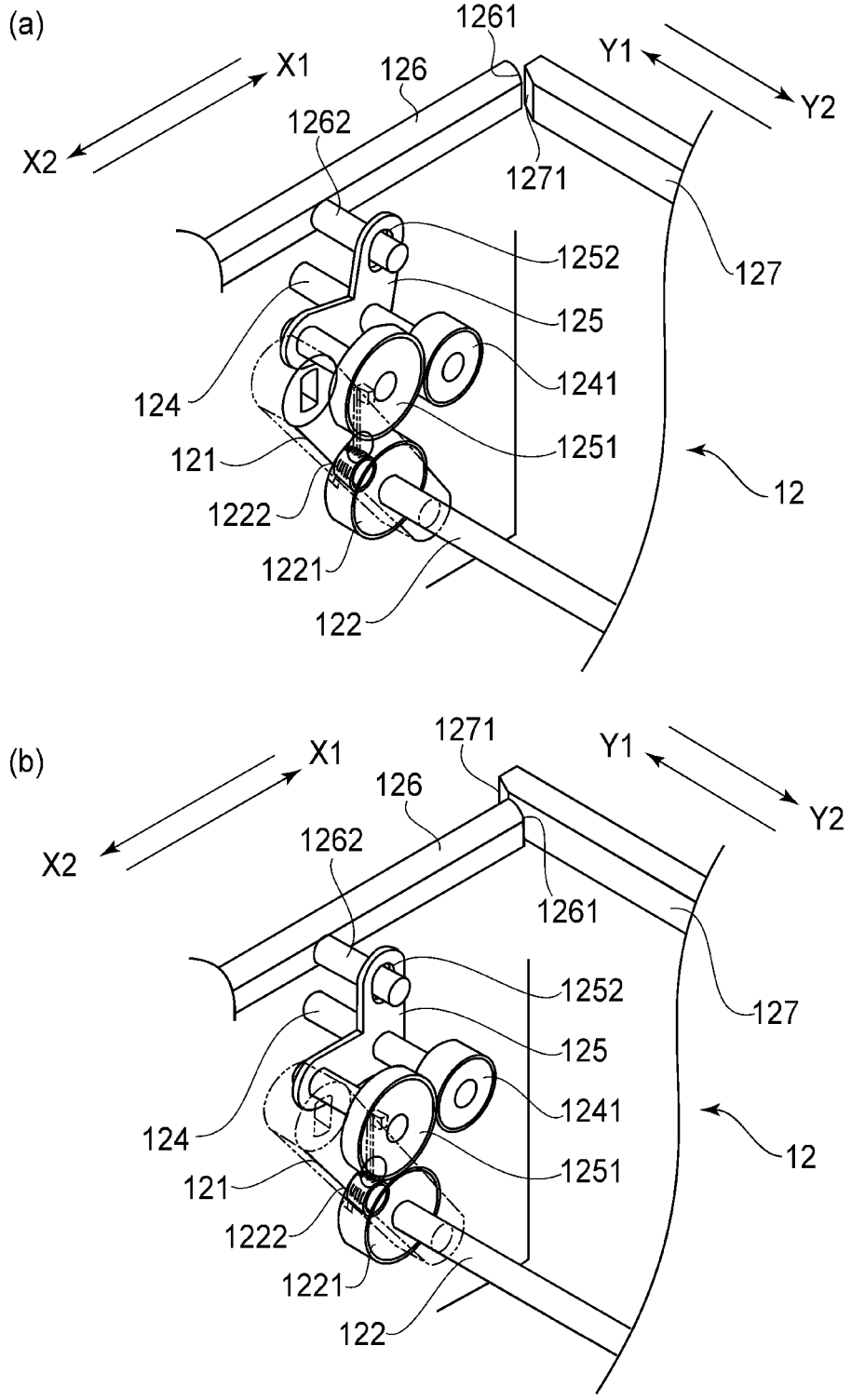

Parts (a) and (b) of FIG. 11 are partly enlarged perspective views of the moving mechanism at a near side.

Figure 12:
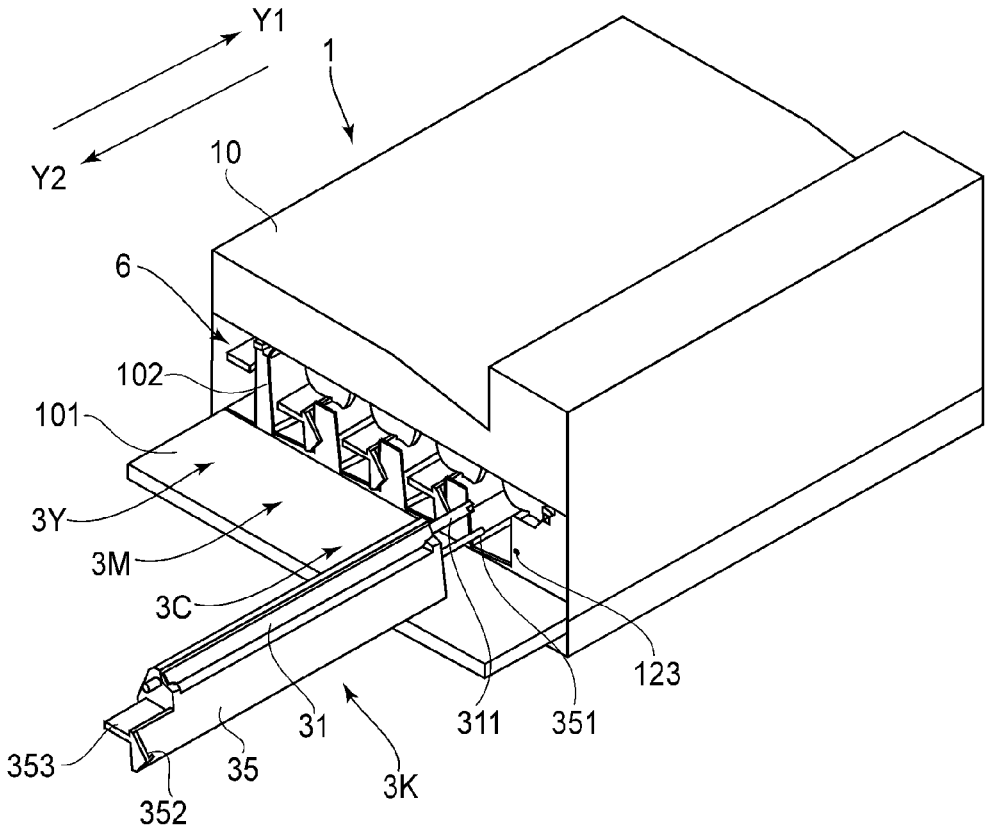

FIG. 12 is a perspective view showing a structure of a pulled-out cartridge and the apparatus main assembly.

Figure 13:
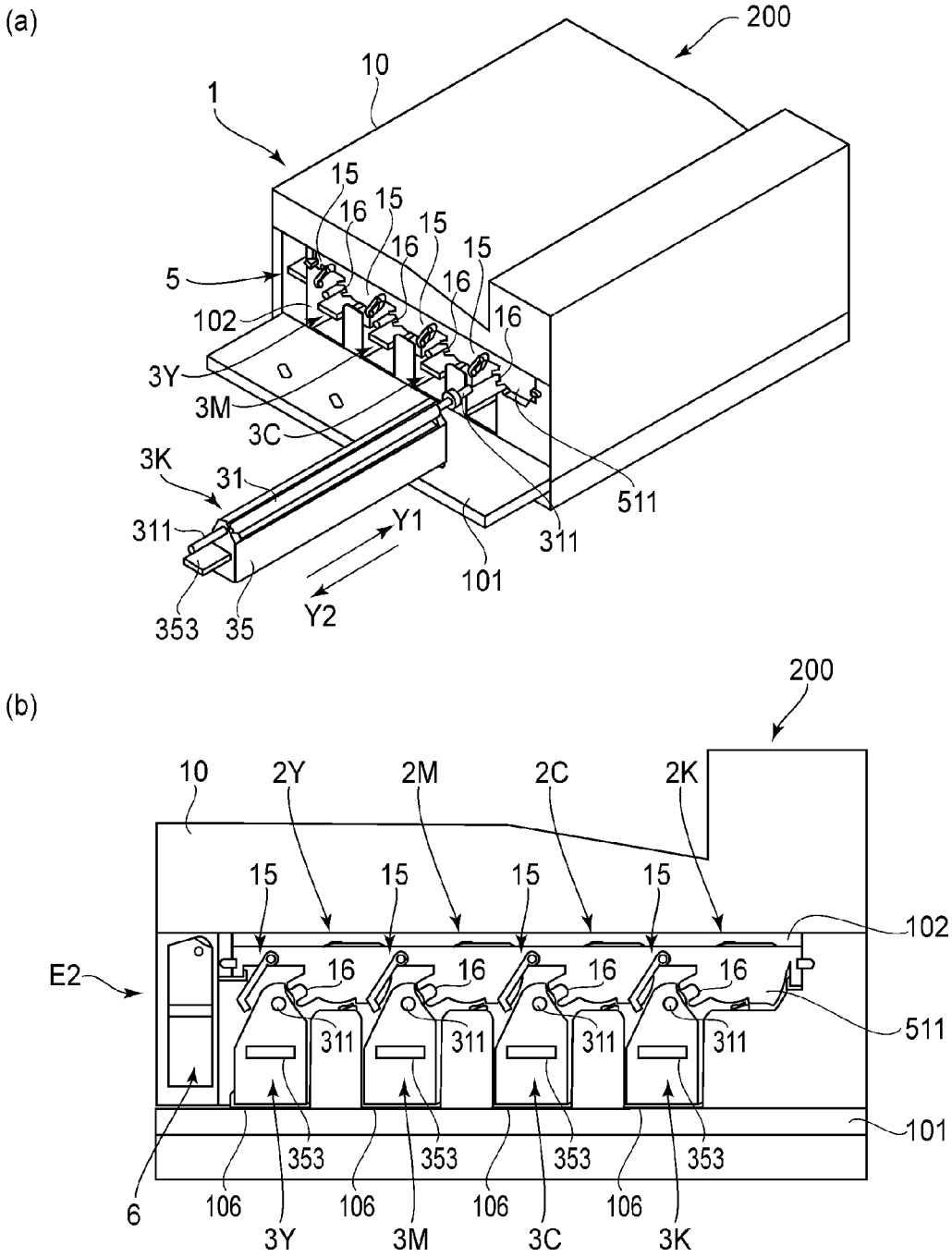

Parts (a) and (b) of FIG. 13 are a perspective view and a sectional view, respectively, showing a structure of an image forming apparatus in Embodiment 2.

Figure 14:
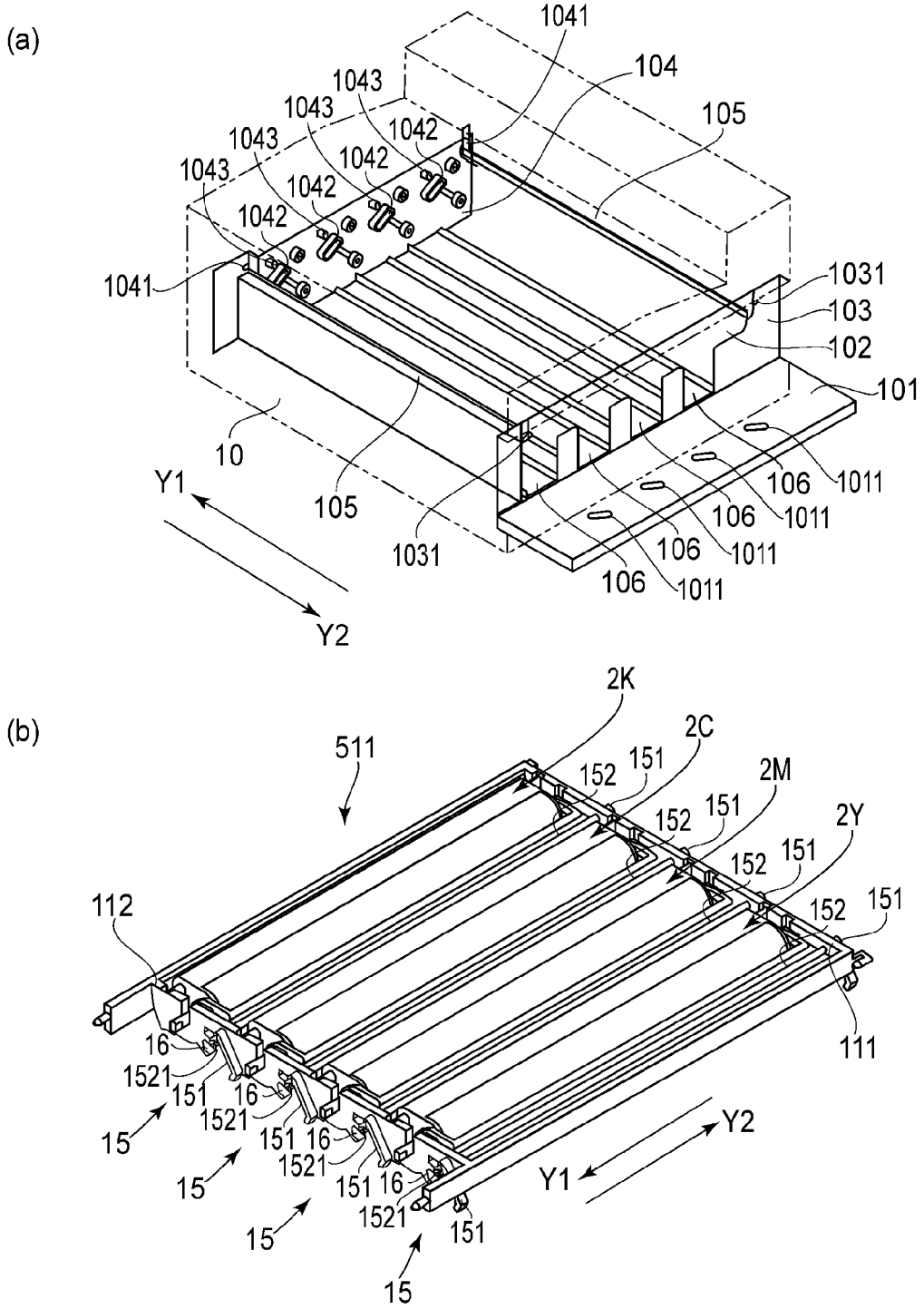

Parts (a) and (b) of FIG. 14 are perspective views showing a structure of an apparatus main assembly.

Figure 15:
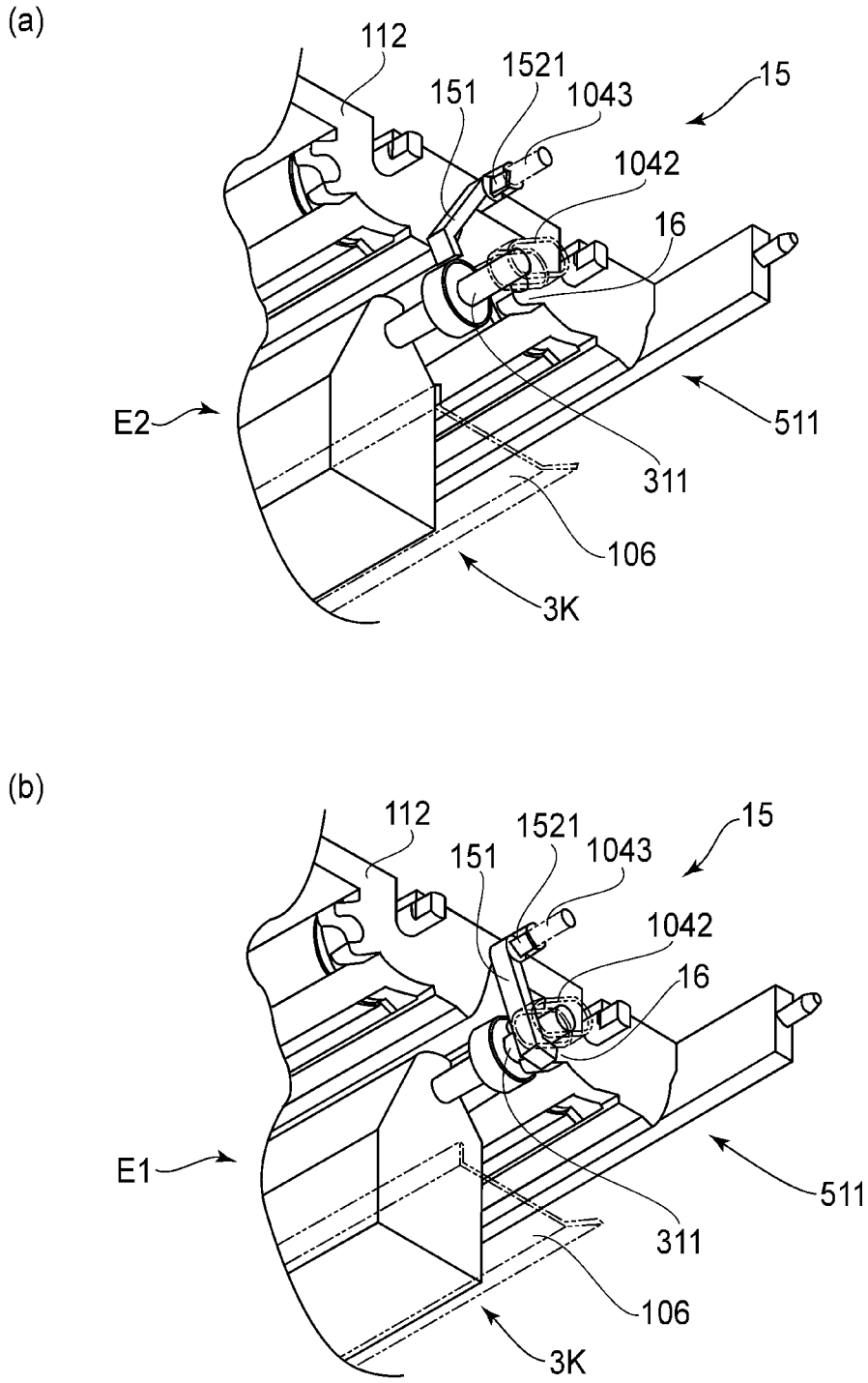

Parts (a) and (b) of FIG. 15 are partly enlarged perspective views showing a structure of a moving mechanism.

Figure 16:
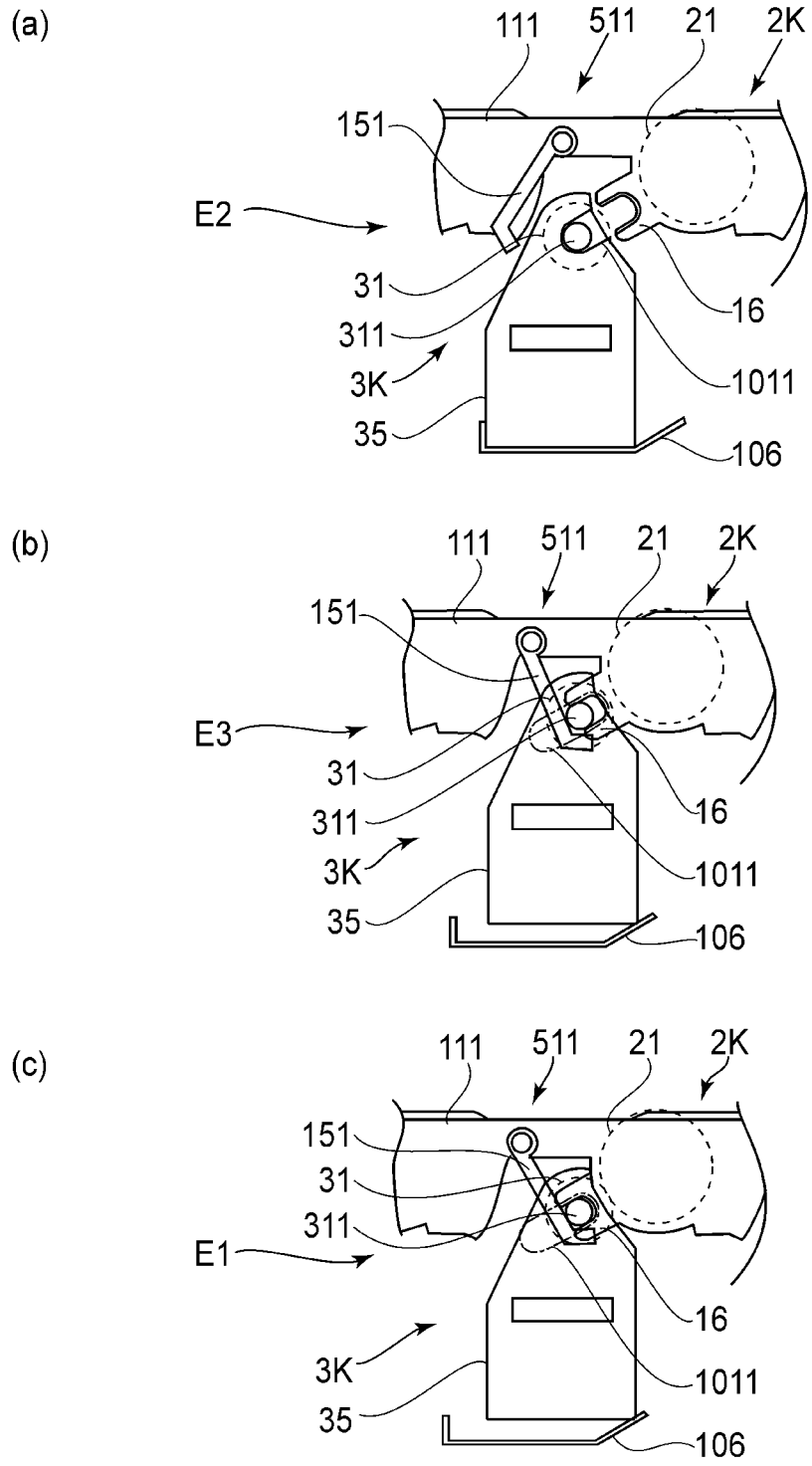

Parts (a) to (c) of FIG. 16 are front views, of the image forming apparatus, for illustrating an operation of an arm.

Figure 17:
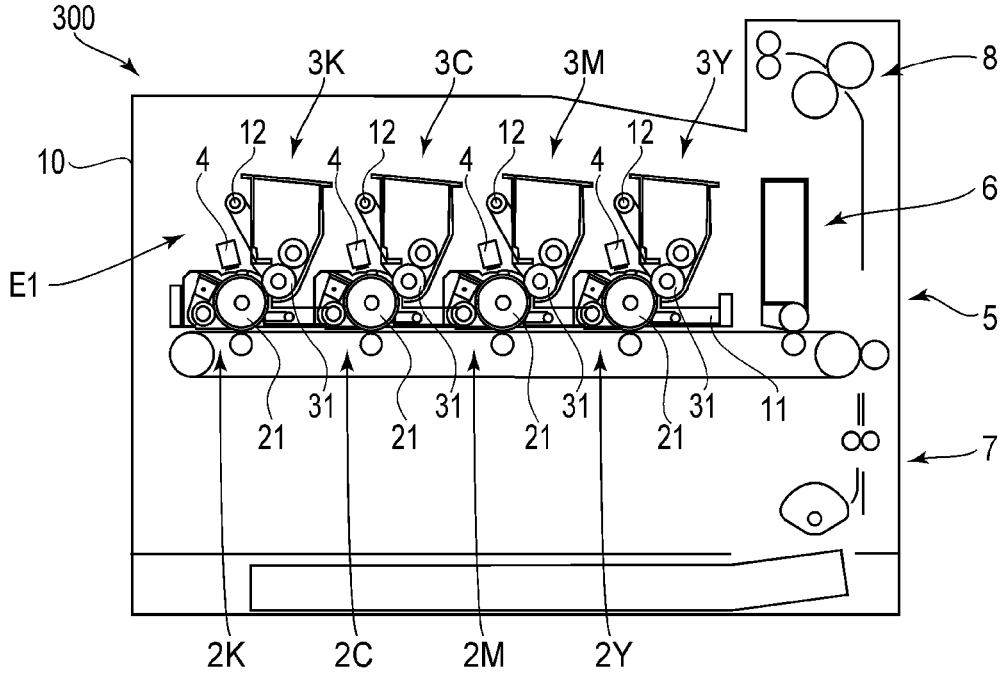
Figure 17:
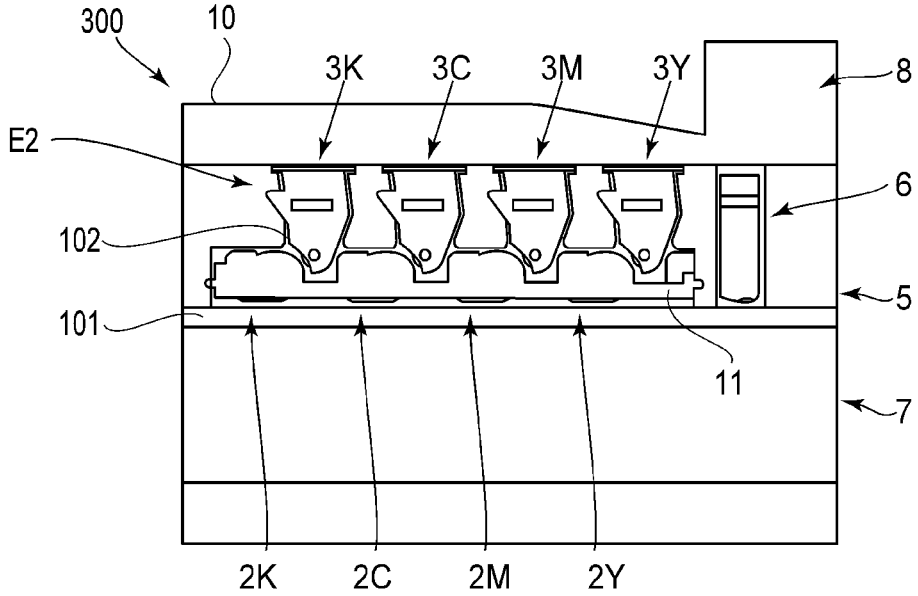

Parts (a) and (b) of FIG. 17 are sectional views showing a structure of an image forming apparatus in Embodiment 3.

Figure 18:
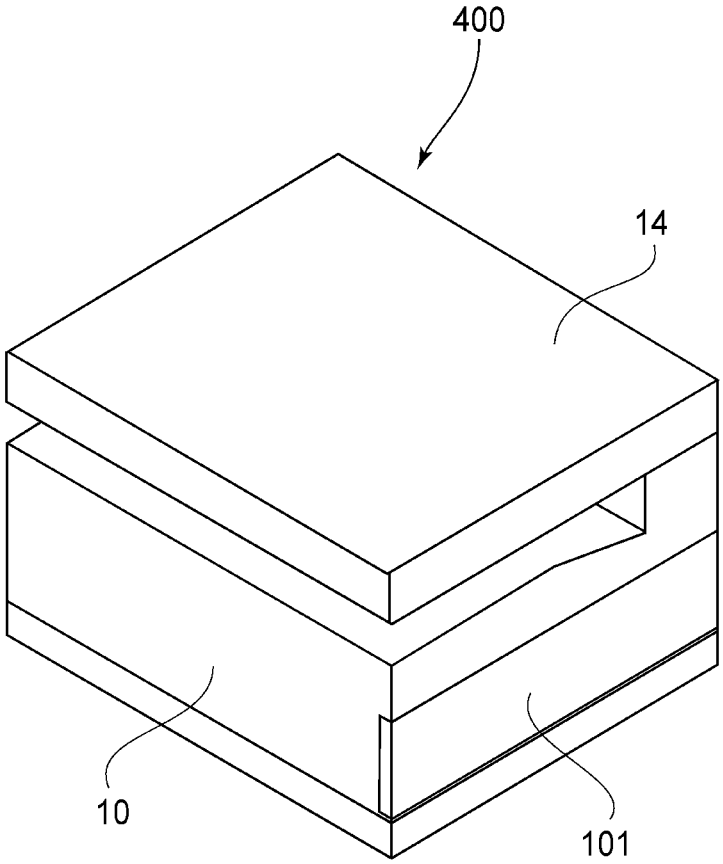

FIG. 18 is a perspective view showing a structure of an image forming apparatus in which an image reading device (image scanner) is mounted on an apparatus main assembly.

DESCRIPTION OF THE PREFERRED EMBODIMENTS

The present invention will be described in detail based on the following embodiments with reference to the drawings. However, dimensions, materials, shapes, relative positions and the like of constituent elements (parts) described in the following embodiments may be appropriately modified depending on a constitution of an image forming apparatus to which the present invention is applied or depending on various conditions. Therefore, the scope of the present invention is not limited to those unless otherwise specified.

Embodiment 1

Figure 1A:
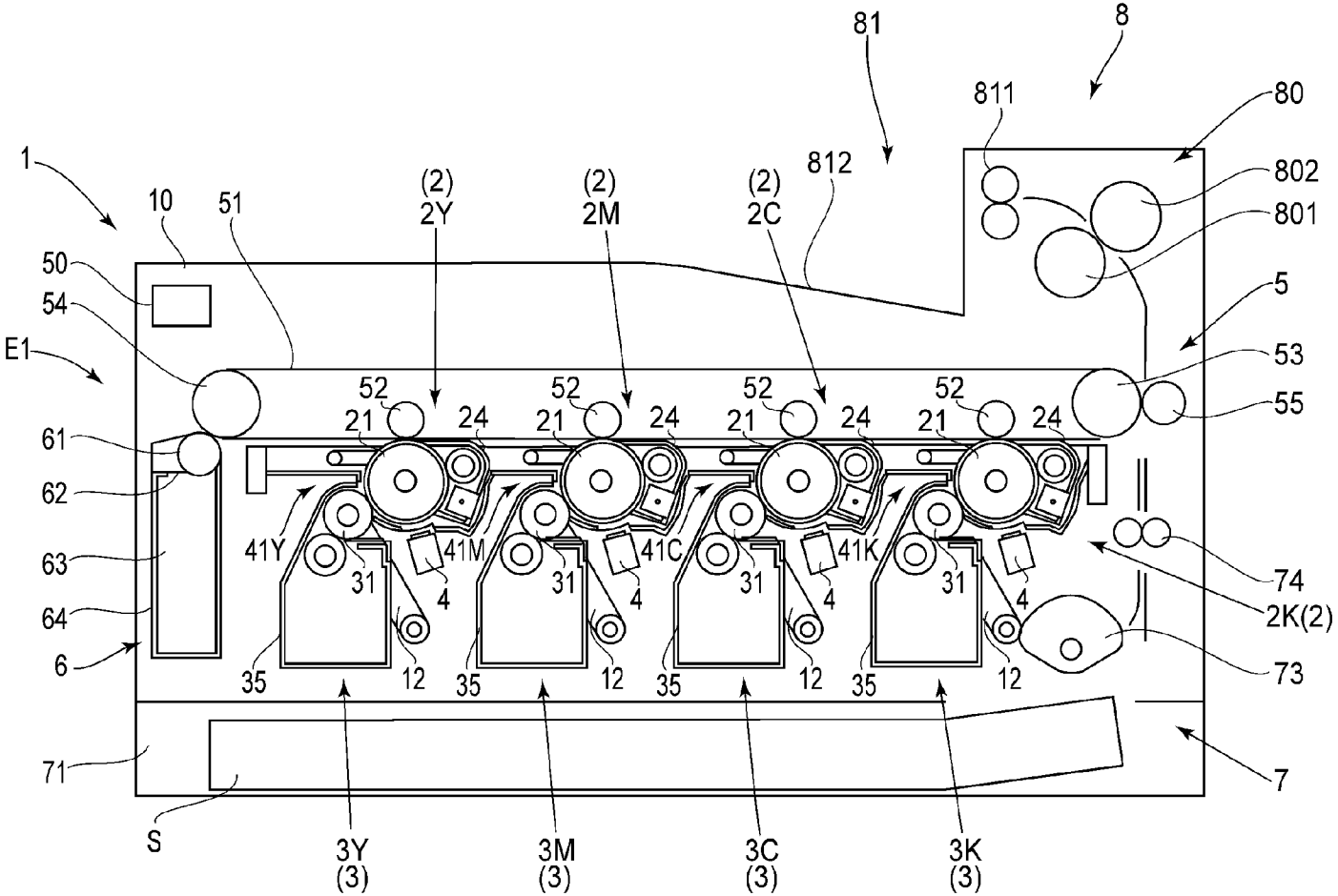
FIGS. 1A and 1B are sectional views showing a structure of an image forming apparatus in Embodiment 1.

FIG. 1A is a sectional view showing a structure of an image forming apparatus 1 in this embodiment. The image forming apparatus 1 is a color electrophotographic image forming apparatus using an electrophotographic image forming process. As shown in FIG. 1A, the image forming apparatus 1 includes an apparatus main assembly 10, as an image forming apparatus main assembly, in which image forming portions 41Y, 41M, 41C and 41K for forming images of yellow (Y), magenta (M), cyan (C) and black (K) are provided. Each of the image forming portions 41Y, 41M, 41C and 41K includes an electrophotographic photosensitive drum 21, and a transfer roller 52 (primary transfer roller) as a transfer device.

Inside the apparatus main assembly 10, cartridges (drum cartridges) 2Y, 2M, 2C and 2K are juxtaposed. Each of the cartridges 2Y to 2K includes a frame 24, as a drum cartridge frame, by which the photosensitive drum 21 is rotatably supported. Further, to the frame 24, a charger 22 ((a) of FIG. 2) and a roller 23 (cleaning roller) ((a) of FIG. 2) which are described later are attached. Further, inside the apparatus main assembly 10, below to the left of each cartridge 2 (2Y, 2M, 2C, 2K), a cartridge 3 (3Y, 3M, 3C, 3K) is provided. Each of the cartridges 3Y to 3K includes a frame (developing cartridge frame) 35 by which a developing roller 31 is rotatably supported. Each developing roller 31 develops an electrostatic latent image at a surface of each photosensitive drum 21. That is, the developing roller 31 develops, with a powdery developer, the electrostatic latent image formed on the photosensitive drum 21, so that a developer image is formed on the surface of the photosensitive drum 21. Here, the cartridge 3Y include an accommodating portion (developer accommodating portion) 23 ((a) of FIG. 2) for accommodating a yellow powdery developer. The cartridge 3M includes an accommodating portion 32 for accommodating a magenta powder developer. The cartridge 3C includes an accommodating portion 32 for accommodating a cyan powdery developer. The cartridge 3K includes an accommodating portion 32 for accommodating a black powdery developer. The cartridges 2Y and 3Y are used in a pair to form a yellow image. The cartridges 2M and 3M are used in a pair to form a magenta image. The cartridges 2C and 3C are used in a pair to form a cyan image. The cartridges 2K and 3K are used in a pair to form a black image.

Between each of the cartridges 2Y to 2K and each of the cartridges 3Y to 3K, i.e., between the charger (charging roller) 22 of each of the cartridges 2Y to 2K and the developing roller 31 of each of the cartridges 3Y to 3K, an LED head 4 as an exposure means is provided. The LED head 4 forms the electrostatic latent image on the photosensitive drum 21. Above each of the cartridges 2Y to 2K, a primary transfer roller (transfer means) 52 for transferring the developer image formed on the surface of the photosensitive drum 21 is provided.

At a left side of the image forming portion 41Y, a residual developer cartridge (residual developer accommodating portion) 6 is disposed. From below the image forming portions 41Y to 41K to below to the right of the image forming portion 41K, a conveying portion 7 for feeding and conveying a sheeting (recording material) S is provided. On the image forming portions 41Y to 41K, a belt 51 (transfer belt) is provided. At a right side of the belt 51, a transfer portion for transferring the developer image, transferred on the belt 51, onto the sheet S is provided. Above to the right of the image forming portion 41K, a fixing and discharging portion 8 for fixing the developer image on the sheet S and for discharging the sheet S is provided.

The conveying portion 7 feeds the sheet S toward the transfer portion 5 and includes a (feeding) cassette 71, a (feeding) roller 73 and a registration roller pair 74. In the cassette 71, a plurality of sheets S are stacked and accommodated. The roller 73 rotates depending on an image forming operation and feeds the sheets S one by one from the cassette 71. The registration roller pair 74 performs, during the image forming operation, a non-rotational operation by which the sheet S conveyed from the registration roller pair 74 is stopped and placed in a stand-by state. Further, the registration roller pair 74 is driven by a predetermined sequence including a rotational operation for conveying the sheet S toward the transfer portion 5. Further, the registration roller pair 74 effects positional alignment between the developer image and the sheet S in a transfer step as a subsequent step.

Part (a) of FIG. 2 is an enlarged schematic view showing the structure (constitution) of the image forming portion 4Y. Herein, only the constitution of the cartridges 2Y and 3Y will be described but other cartridges 2M, 2C and 2K and 3M, 3C and 3K have the same constitution. For that reason, the description of the cartridges 2Y and 3Y can also be true for other cartridges. With reference to (a) of FIG. 2, an image forming process of the image forming apparatus 1 will be described. The image forming process refers to a step of forming the developer image on the belt 51 by each of the image forming portions 41Y to 41K. The image forming process is effected by the photosensitive drum 21 and process means disposed around the photosensitive drum 21. Examples of the process means include the charger (charging means) 22, the LED head (electrostatic latent image forming means) 4, the developing roller (developing means) 31, the primary transfer roller (transfer means) 52 for transferring the developer image onto the belt 51, and a cleaning roller (cleaning means) 23.

As described above, the image forming portion 41Y principally includes the cartridge 2Y, the LED head 4, the cartridge 3Y and the transfer roller 52. First, the photosensitive drum 21 disposed inside the frame 24 of the cartridge 2Y includes a cylinder having a photosensitive layer of an organic photoconductor at its sensitive layer of an organic photoconductor at its surface. The photosensitive drum 21 rotates clockwise as indicated by an arrow during the image formation. The charger 22 uniformly charges the surface of the photosensitive drum 21 by a charging bias applied from a bias applying means (not shown). Incidentally, in this embodiment, for the charger 22, a corona charging system is employed but a roller charging system may also be employed.

Next, the LED head 4 forms the electrostatic latent image on the charged surface of the photosensitive drum 21. The LED head 4 is a light emitting element array including a plurality of light emitting elements, such as light emitting diode (LED), arranged in a line. Each light emitting element emits light depending on image information, so that the surface of the photosensitive drum 21 is exposed to the emitted light. As a result, on the surface of the photosensitive drum 21, the electrostatic latent image is formed. Incidentally, in this embodiment, as the electrostatic latent image forming means, the light emitting element array is employed but a laser scanner may also be employed.

Next, the cartridge 3Y includes the frame 35. To the frame 35, the developing roller 31 is rotatably attached and a supplying roller 31 is attached opposed to the developing roller 31. Further, in contact with the surface of the developing roller 3, a (developing) blade 33 is attached to the frame 35. The developing roller 31 is a roller for developing, with the powdery developer, the electrostatic latent image formed on the surface of the photosensitive drum 21. The supplying roller 34 supplies the developer to the surface of the developing roller 31. The blade 33 is disposed at a position in contact with the surface of the developing roller 31 at its end and is used for regulating a layer thickness of the developer carried on the developing roller 31 and for imparting an electric charge to the developer. Inside the frame 35, the accommodating portion 32 as a space in which the developer can be accommodated is ensured. The developing roller 31 is disposed at a position in which the developing roller 31 opposes the photosensitive drum 21.

The developing roller 31 rotates counterclockwise when the image forming process is executed. At this time, the developing roller 31 is located at a developing position E1 ((a) of FIGS. 1 and 2) in which the developing roller 31 contacts the photosensitive drum 21. Further, the supplying roller 34 rotates counterclockwise similarly as in the case of the developing roller 31 and supplies the developer to the developing roller 31. When the developer supplied to the developing roller 31 passes through the blade 33, the layer thickness of the developer is regulated and at the same time the electric charge is imparted to the developer. On the other hand, a developing bias is applied from a bias applying means (not shown) to the developing roller 31, so that the developer on the surface of the developing roller 31 is deposited on the electrostatic latent image formed on the photosensitive drum 21. As a result, by using the developer, the electrostatic latent image is developed into the developer image to be visualized by the developing roller 31. At the developing position E1, the photosensitive drum 21 and the developing roller 31 contact each other and the image forming process (developing process) is executable.

In this embodiment, as the developer, a non-magnetic one component developer using a non-magnetic toner is used. However, it is also possible to employ a two component developer containing the non-magnetic toner and a magnetic carrier. Further, the developing roller 31 of a contact type in which the developing roller 31 and the photosensitive drum 21 is described but it is also possible to employ a developing roller of a non-contact type in which the photosensitive drum and the developing roller provide a predetermined gap. Thus, the developing position may also include the case where the photosensitive drum 21 and the developing roller 31 do not contact each other.

The transfer roller 52 will be described. On the photosensitive drum 21, the belt 51 is disposed in contact with the photosensitive drum 21 and on the belt 51, the transfer roller 52 is disposed. The photosensitive drum 21 and the transfer roller 52 sandwich the belt 51. The transfer roller 52 primary-transfers the developer image, developed from the electrostatic latent image on the photosensitive drum 21, onto the belt 51. The transfer roller 52 rotates counterclockwise when the image forming process is executed and is supplied with a primary transfer bias from a bias applying means (not shown). The developer image carried onto the belt 51 when it passes through the nip between the transfer roller 52 and the photosensitive drum 21.

Next, the roller 23 of the cartridge 2Y will be described. The roller 23 removes the developer remaining on the surface of the photosensitive drum 21. The roller 23 rotates counterclockwise when the image forming process is executed. To the roller 23, a cleaning bias is applied by a bias applying means (not shown). On the photosensitive drum 21 subjected to the primary transfer, the developer which is not completely transferred remains. The remaining developer is collected, in the nip between the roller 23 and the photosensitive drum 21, as a residual developer on the roller 23 to which the bias is applied. Incidentally, in this embodiment, a method using the roller 23 is used for the cleaning but a cleaning blade may also be used. By repeating the above-described process from the charging to the cleaning, it is possible to continuously perform the image forming process.

The transfer portion 5 will be described with reference to FIG. 1A. The transfer portion 5 includes the belt 51, the transfer roller 52, a roller (transfer driving roller), a roller 54 (tension roller) and a transfer roller 55 (secondary transfer roller). The belt 51 carries the developer image formed by the above-described image forming process. The transfer roller 52 transfers the developer image from the photosensitive drum 21 onto the belt 51. The roller 53 conveys the belt 51. The roller 54 provides a tension to the belt 51. The transfer roller 55 transfers the developer image from the belt 51 onto the sheet S.

The roller 53 rotates counterclockwise to convey the belt 51. The image forming process described above is successively performed with respect to the respective photosensitive drums 21 of the cartridges 2 (2Y to 2K). On the surface of the belt 51, the developer images of yellow, magenta, cyan and black are successively superposed, so that a full-color developer image is carried and is conveyed toward the transfer roller 55. The transfer roller 55 rotates clockwise. In synchronism with timing when the developer image carried on the belt 51 passes through the nip between the transfer roller 55 and the belt 51, the registration roller pair 74 rotates. As a result, the sheet S is conveyed into the nip between the transfer roller 55 and the belt 51. To the transfer roller 55, a secondary transfer bias is applied by a bias applying means (not shown). As a result, the developer image carried on the belt 51 is transferred onto the sheet S.

Next, with reference to FIG. 1A, the fixing and discharging portion 8 will be described. The fixing and discharging portion 8 includes a fixing portion 80 for fixing the developer image transferred on the sheet S and a discharging portion 82 for discharging the sheet S, on which the developer image is fixed, to the outside of the apparatus main assembly 10. First, the fixing portion 80 includes a heating roller 801 and a pressing roller 802. The heating roller 801 includes a heating means (not shown) at its inside and is heated to a predetermined temperature. The pressing roller 802 is pressed against the heating roller 801 at predetermined pressure by a pressing means (not shown).

When the sheet S on which the developer image is transferred by the transfer portion 5 passes through the nip between the heating roller 801 and the pressing roller 802, heat and pressure are applied. As a result, the developer image is fixed on the sheet S, so that the image is formed on the sheet S.

The discharging portion 81 includes a roller pair (discharging roller pair) 811 and a stacking portion 812. The sheet S on which the developer image is fixed is, after passing through the fixing portion 80, conveyed to the discharging portion 81. The roller pair 811 is used for discharging the sheet S to the outside of the apparatus main assembly 10 and is rotated by a driving means (not shown). At the stacking portion 812, the sheet S on which the developer image is fixed, i.e., the image formation is completed is stacked.

Next, with reference to FIG. 1A, the cartridge 6 (residual developer cartridge) will be described. The cartridge 6 includes a roller 61 (residual developer collecting roller) for collecting the developer deposited on the belt 51 and a scraper 62 for scraping the collected developer. Further, the cartridge 6 includes a container 63 (residual developer collecting container) for accommodating the collected developer and a residual developer cartridge frame 64 for integrally assembling these members. In the image forming process, the developer image carried on the belt 51 is transferred onto the sheet S by the transfer roller 55. At this time, the developer remaining on the belt 51 is conveyed to the roller 61 while being deposited on the belt 51.

The roller 61 is supplied with a collecting bias by a bias applying means (not shown) and rotates clockwise. Then, in the nip between the belt 51 and the roller 61, the developer remaining on the belt 51 is collected. The developer collected by the roller 61 is scraped off of the roller 61 by the scraper 62, thus being collected as the residual developer in the container 63. Further, also when a collecting process described in detail later is performed, the residual developer is similarly collected. When the developer is collected in the container 63 in a predetermined amount, the cartridge 6 is replaced with a new residual developer cartridge.

Figure 1B:
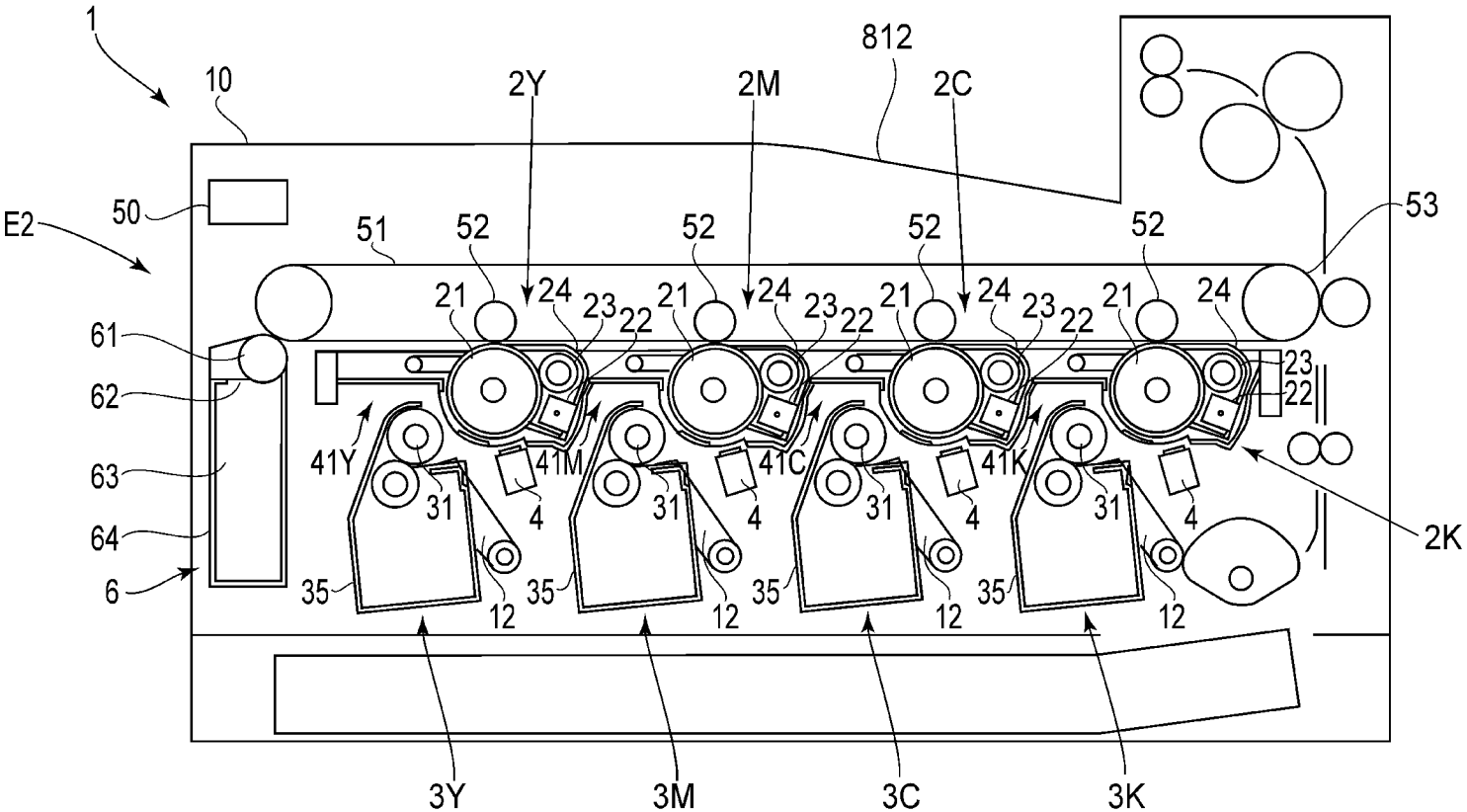

FIG. 1B is a sectional view showing the structure of the image forming apparatus 1. With reference to FIG. 1B in combination with FIG. 1A, the developer collecting process will be described. In the collecting process, the residual developer collected by the roller 23 in the above-described cleaning process is collected by the cartridge 6 on the basis of control of a controller 50. In the case where the image forming process is executed, the cartridges 3 (3Y to 3K) are disposed at the developing position E1 in which each developing roller 31 and each photosensitive drum 21 are placed in a contact state (FIG. 1A).

On the other hand, in the case where the collecting process is executed, the developing roller 31 is moved to a retracted position E2 (FIG. 1B and (a) and (b) of FIG. 5) in which the developing roller 31 is retracted from the photosensitive drum 21 by a developing cartridge moving mechanism 12 described later.

When each cartridge 3 is disposed at the retracted position E2, the controller 50 drives the roller 23, the photosensitive drum 21, the roller 53 and the roller 61. To the roller 23, a discharging bias is applied by a bias applying means (not shown). The discharging bias is a bias (voltage) for discharging the residual developer, collected by the roller 23 to the photosensitive drum 21. When the discharging bias is applied, the residual developer is, after being collected by the roller 23, discharged onto the photosensitive drum 21 and is moved toward the developing roller 31 with the rotation of the photosensitive drum 21. However, the developing roller 31 is disposed at the position in which the developing roller 31 is spaced from the photosensitive drum 21, so that the residual developer passes through an opposing position between the photosensitive drum 21 and the developing roller 31 and is conveyed to the transfer roller 52. Incidentally, at the retracted position E2, the photosensitive drum 21 and the developing roller 31 are separated from each other and the unit 11 and each of the cartridges 3 (3Y to 3K) are detachably mountable. Further, during the collecting process, when the image forming apparatus 1 is stopped, each cartridge 3 is disposed at the retracted position E2. Further, during monochromatic image formation, the cartridges 3Y, 3M and 3C are disposed at the retracted position E2 and the cartridge 3K is disposed at the developing position E1.

To the transfer roller 52, a collecting transfer bias is applied by a bias applying means (not shown), so that the residual developer is moved to the belt 51. The residual developer moved to the belt 51 is conveyed toward the roller 61 with the mount of the belt 51. To the roller 61, the collecting bias is applied by the bias applying means (not shown), so that the residual developer conveyed by the belt 51 is collected. The collected residual developer is scraped off of the roller 61 by the scraper 62 to be collected in the container 63. The discharging bias, the collecting transfer bias and the collecting bias may also be optimized depending on the charge polarity of the developer collected by the roller 23. For example, in the case where the charge polarity of the collected developer is positive (+), the polarities may be set at positive (+) for the discharging bias and at negative (−) for the collecting transfer bias and the collecting bias. Further, in the case where the charge polarity of the collected developer is negative (−), reverse setting of the polarities may be made. Further, in the case where the charge polarity of the collected developer is negative, the charge polarity of the collected developer is changed to positive and then the bias polarity can be set at negative for the collecting transfer bias and the collecting bias.

In the case where the collecting process is completed and the image forming process is executed again, each cartridge 3 is moved to the developing position E1 (FIG. 1A) by the moving mechanism 12. As described above, when the image forming process and the collecting process is repeated, the continuous image format can be effected. However, the collecting process may also be not performed every image formation. For example, execution timing of the collecting process may also be determined depending on collecting power or the like for collecting the developer by the roller 23. When the continuous image formation is executed, an interruption of the collecting process can be caused with predetermined timing.

Part (a) of FIG. 2 is a sectional view showing the structure of the cartridge 2Y. As shown in (b) of FIG. 2, to the frame 24, a shaft 211 (drum shaft) of the photosensitive drum 21 and a holding portion 241 which can be held by the user when the user mounts and demounts the cartridge 2Y are attached. The holding portion 241 is constituted so that the cartridge 2Y can be rotationally moved about the shaft 211 while the user holds the holding portion 241.

Part (c) of FIG. 2 is a perspective view showing the structure of the cartridge 2Y. As shown in (c) of FIG. 2, from a side where each of longitudinal ends of the frame 24 is located, the shaft 211 as a rotation shaft of the photosensitive drum 21 and a shaft 231 (cleaning roller shaft) as a rotation shaft of the roller 23 ((b) of FIG. 2) are protruded. Further, to the frame 24, the holding portion 241 which can be rotationally movable about the shaft 211 and can be held by the user, and an engaging portion 242 which can be movable along the shaft 211 and through which the shaft 211 penetrates are attached. The engaging portion 242 includes a recessed portion 242*a* engageable with a drum cartridge fixing member 115 described later and engages with the fixing member 115 (FIG. 8).

The holding portion 241 and the engaging portion 242 rotationally move about the shaft 211 in an arrow direction and therefore as shown in (b) of FIG. 2, the holding portion 241 rotationally moves counterclockwise from a position of a solid line to a position of a chain double-dashed line. The constitution and operation of the holding portion 241 and the engaging portion 242 will be specifically described later. The photosensitive drum 21 and the roller 23 are deteriorated with repetition of the image forming operation and are replaced when they reach their ends of predetermined lifetimes. In this case, the photosensitive drum 21, the charger 22 and the roller 23 are integrally assembled with the frame 24, so that an exchanging operativity is not impaired.

Part (a) of FIG. 3 is a sectional view showing the structure of the cartridge 3. As shown in (a) of FIG. 3, the cartridge 3Y is prepared by integrally assembling the developing roller 31, the supplying roller 32 and the blade 33 with the frame 35. The developing roller 31 is rotatable about a shaft 311 (developing roller shaft).

Part (b) of FIG. 3 is a perspective view showing the structure of the cartridge 3. As shown in (b) of FIG. 3, the shaft 311 is disposed so as to be protruded in a longitudinal direction of the frame 35. The frame 35 is provided with an engaging portion 351 (rear side engaging portion), an engaging portion 352 (front side engaging portion) and a holding portion 353. The constitution and operation of the engaging portions 351 and 353 and the holding portion 353 will be described more specifically later. The developing roller 31, the blade 33 ((a) of FIG. 3) and the supplying roller 34 ((a) of FIG. 3) are deteriorated with repetition of the image forming operation. Further, the developer accommodated in the accommodating portion 32 is consumed with the repetition of the image forming operation. Therefore there members are replaced when they reach ends of predetermined lifetimes. In this case, the developing roller 31, the accommodating portion 32, the blade 33 and the supplying roller 34 are integrally assembled with the frame 35, so that exchanging operativity is not impaired ((a) of FIG. 3).

Part (a) of FIG. 4 shows the structure of the image forming apparatus 1 and is a perspective view showing the structure in which a cartridge cover 101 is in a closed state. As shown in (a) of FIG. 4, the cover 101 as an openable member is openably attached at one of side surfaces of the apparatus main assembly 10 ((b) of FIG. 4).

Part (b) of FIG. 4 shows the structure of the image forming apparatus 1 and is a perspective view showing the structure in which the cover 101 is in an open state. As shown in (b) of FIG. 4, when the cover 101 is opened, an opening 102 (mounting and demounting opening) for permitting mounting and demounting of each of the cartridges 2 (2Y to 2K) and each of the cartridges 3 (3Y to 3K) with respect to the apparatus main assembly 10 is exposed.

Part (a) of FIG. 5 is a sectional view showing the structure of the image forming apparatus 1 and shows a state in which the cover 101 is opened. When the cover 101 is opened, as shown in (a) of FIG. 5, the belt 51, the transfer roller 52, the roller 53 and the roller 54 are moved upward by a link mechanism (not shown), so that the photosensitive drum 21 and the belt 51 are placed in a spaced (separated) state. Further, when the cover 101 is opened, by the moving mechanism 12, each cartridge 3 is moved to the retracted position E2. At this time, the photosensitive drum 21 is detachably and mountably supported by a drum cartridge supporting unit 11 ((b) of FIG. 5).

Part (b) of FIG. 5 is a front view showing the structure of the image forming apparatus 1 and shows a state in which the cover 101 is opened. The opening 102 is exposed. At this time, each cartridge 3 is disposed at the retracted position E2 in which each cartridge 3 does not interfere with the unit 11 and the opening 102. The unit 11, each cartridge 3 and the cartridge 6 can be pulled out toward the front side in (b) of FIG. 5. Further, each cartridge 2, each cartridge 3 and the cartridge 6 are replaced.

Part (a) of FIG. 6 is a perspective view showing the structure of the image forming apparatus 1 and shows a state in which the unit 11 is pulled out toward the front side. As shown in (b) of FIG. 6, the user pulls on the unit 11 to the front side, so that the four cartridges 2Y to 2K are collectively pulled out to the outside of the apparatus main assembly 10.

Part (b) of FIG. 6 is a perspective view showing the structure of the image forming apparatus 1 and shows a state in which the unit 11 is pulled out toward the front side and the holding portion 241 of the cartridge 2K is raised up. As described above, the holding portion 24 of the cartridge 2K is swingable about the shaft 211 ((c) of FIG. 2). When the user demounts the cartridge 2K from the unit 11, as shown in (b) of FIG. 6, the user swings the holding portion 241 to release the fixing between the cartridge 2K and the unit 11 as described later more specifically.

FIG. 7 is a perspective view showing the structure of the image forming apparatus 1 and shows a state in which the cartridge 2K is disconnected from the unit 11. The cartridge 2K having the holding portion 241 which is raised up is in a state in which the fixing with the unit 11 is released. Therefore, as shown in FIG. 7, the cartridge 2K is demountable toward above the unit 11 by the user.

When the cartridge 2K is mounted, the reverse of the above operation may be effected. Incidentally, in the description made with reference to (b) of FIG. 6 and FIG. 7, the black cartridge 2K is used as an example but other cartridges 2Y, 2M and 2C may also be similarly used. That is, the cartridges 2Y, 2M and 2C can be demounted and mounted in the same manner as in the case of the cartridge 2K.

The supporting unit drum cartridge supporting unit) 11 supports the cartridges 2Y to 2K. Here, a position in which the photosensitive drum 21 is subjected to the image formation at the inside of the apparatus main assembly 10 is a first position D1, and a position in which the photosensitive drum 21 is detachably mountable to the apparatus main assembly 10 at the outside of the apparatus main assembly 10 is a second position D2. The unit 11 is movable in the axial direction of the photosensitive drum 21 between the first position and the second position. The unit 11 includes a side plate (font side plate) 111 and a side plate (rear side plate) 112. The side plate 111 is provided with a groove (drum shaft groove) 113 for receiving the shaft 211, and the side plate 112 is provided with a groove (cleaning roller shaft groove) 114 for receiving the shaft (cleaning roller shaft) 231. Each of the grooves 113 and 114 has a U-shape which opens upward.

The unit 11 includes a fixing member (drum cartridge positioning portion) 115. The fixing member 115 is rotatably supported. The fixing member 115 is provided with a groove 1151 (U-shaped groove). In the above-described constitution, in the case where each cartridge 2 is mounted in the unit 11, the shaft 211 is positioned by the grooves 113 and 1151. Further, the shaft 211 is fixed by rotation of the fixing member 115.

The fixing member 115 is disposed inside the groove 113. The groove 1151 provided to the fixing member 115 has a U shape which opens upward in a state in which each cartridge 2 is mounted or demounted.

Further, a dimension of the groove 113 is larger than that of the shaft 211, so that the groove 113 and the shaft 211 are engageable. Further, the grooves 113 and 1151 have the same shape. Further, the fixing member 115 is supported swingably on the basis of a center of an arc of the groove 1151.

The cartridge 2K is mounted from above the unit 11. In this case, the shaft 211 protruded from the longitudinal ends of the frame 24 are dropped in the grooves 113 and 1151. Similarly, the shaft 231 protruded from the longitudinal ends of the frame 24 is dropped in the groove 114.

Parts (a) and (b) of FIG. 8 are partly enlarged perspective views showing the structure of the unit 11. Part (a) of FIG. 8 corresponds to (b) of FIG. 6 and shows a state in which the cartridge 2K is demountable. Part (b) of FIG. 8 corresponds to (b) of FIG. 6 and shows a state in which the cartridge 2K is prevented from being demounted. With reference to (a) and (b) of FIG. 8, an operation by which the state of the cartridge 2K is changed from the demountable state to the demounting-prevented state will be described. Incidentally, in this embodiment, the cartridge 2K accommodating the black developer is described as an example but other cartridges 2Y, 2M and 2C have the same constitution as that of the cartridge 2K and therefore, the description of the cartridge 2K is also true for other cartridges 2Y, 2M and 2C. In (a) and (b) of FIG. 8, the side plate 111, the groove 113 and the grooves 114 are represented by the chain double-dashed line. Further, (a) of FIG. 8 shows a state in which the holding portion 24 is raised up, and (b) of FIG. 8 shows a state in which the holding portion 241 is laid down. Also with respect to the side plate 112, the same constitution as in the case of the side plate 111 is applicable, so that the description of the constitution and the operation for the side plate 111 is also true for the side plate 112.

As shown in (b) of FIG. 8, when the cartridge 2K is dropped in the unit 11, the shaft 211 is engaged in the grooves 113 and 1151 and the shaft 231 is engaged in the groove 114. Further, the engaging portion 242 engages with the fixing member 115. In this state, the cartridge 2K is in a state in which the cartridge 2K is positioned by the grooves 113 and 1151. The grooves 113 and 1151 open upward. Therefore, the cartridge 2K is not fixed in the unit 11, so that the cartridge 2K can be demounted upward.

As shown in (b) of FIG. 8, when the holding portion 241 is laid down, the fixing member 115 engages with the engaging portion 242 and therefore swings about the center of the shaft 211. At this time, the shaft 211 is still supported by both of the grooves 113 and 1151. The groove 1151 swings together with the fixing member 115. For that reason, the cartridge 2K cannot be pulled out upward. That is, the cartridge 2K is in a state in which the cartridge 2K is positioned and fixed in the unit 11. In the case where the cartridge 2K is demounted from the unit 11, the reverse of the above operation may be performed. Thus, the cartridge 2K is positioned relative to the unit 11 by such a simple constitution that the cartridge 2K is dropped in the upward open grooves provided at the longitudinal ends of the shaft 211 (with respect to the longitudinal direction of the photosensitive drum 21).

Part (a) of FIG. 9 is a perspective view of the unit 11 in a state in which the respective cartridges 2 are mounted. Incidentally, (a) of FIG. 9 is a perspective view of the unit 11 as seen from the side plate 112 side of the unit 11. The unit 11 is movable relative to the apparatus main assembly 10 in a mounting direction Y1 and a pulling-out direction Y2. The mounting direction Y1 and the pulling-out direction Y2 are parallel to the shaft 211 (i.e., the longitudinal direction of the mounted cartridge) (FIG. 7). As shown in (a) of FIG. 9, the unit 11 includes a first guide portion 116*a* and a second guide portion 116*b*, extending in the pulling-out direction Y2, at widthwise ends perpendicular to the pulling-out direction Y2. Further, the unit 11 includes the side plate 112 extending in a direction perpendicular to the mounting direction Y1 at the rear side with respect to the mounting direction Y1. Further, the unit 11 includes the side plate 111 extending in a direction perpendicular to the pulling-out direction Y2 at the front side with respect to the pulling-out direction Y2.

The guide portion 116 is provided with a rear-side positioning pin 117 at an end with respect to the mounting direction Y1 and is provided with a front-side positioning pin 118 which is bent from an end with respect to the pulling-out direction Y2 toward the mounting direction Y1. Similarly, the guide portion 116*b* is provided with a rear-side positioning pin 117 at an end with respect to the mounting direction Y1 and is provided with a front-side positioning pin 118 which is bent from an end with respect to the pulling-out direction Y2 toward the mounting direction Y1. Further, the unit 11 is positioned relative to the apparatus main assembly 10 by the rear-side positioning pins 117 (portions to be positioned) and the front-side positioning pins 118 (portions to be positioned) as described later.

Part (b) of FIG. 9 is a perspective view of the apparatus main assembly 10. In (b) of FIG. 9, for facilitating explanation of mount of the unit 11 and mounting and demounting of the cartridge 3, a portion corresponding to an outer appearance of the apparatus main assembly 10 is indicated by a chain double-dashed line. As shown in (b) of FIG. 9, the apparatus main assembly 10 includes a wall (front wall) 103 at a pulling-out direction Y2 side. The wall 103 is provided with front-side positioning holes (positioning portions) 1031. When the cover 101 is opened relative to the apparatus main assembly 10, the opening 102 provided to the wall 103 is exposed. Through the opening 102, the cartridge 102, the cartridge 2 and the cartridge 3 are detachably mountable. The opening 102 has a shape such that the cartridge 3 is, after being retracted from the cartridge 2 to the retracted position E2 ((a) and (b) of FIG. 5), does not interfere with adjacent cartridges 3 when the cartridge 3 is pulled out from the apparatus main assembly 10.

Further, the apparatus main assembly 10 includes a wall (rear wall) 104 at a mounting direction Y1 side of the unit 11 is provided with rear-side positioning holes (positioning portions) 1041. Between the walls 103 and 104, a first (guide) rail 105*a* and a second (guide) rail 105*b* are provided so as to extend in a direction along the pulling-out direction Y2.

The unit 11 is supported movably, relative to the apparatus main assembly 10 shown in (b) of FIG. 9, in either direction of the mounting direction Y1 and the pulling-out direction Y2. Further, the unit 11 is accommodated at the first position D1 ((b) of FIG. 4) inside the apparatus main assembly 10 when the unit 11 is moved in the mounting direction, and is disposed at the second position D2 ((a) of FIG. 6) outside the apparatus main assembly 10 when the unit 11 is moved in the pulling-out direction Y2.

Further, in the case where the unit 11 is mounted in the apparatus main assembly 10, the guide portion 116*a* ((a) of FIG. 9) engages with the rail 105*a* and the guide portion 116*b* ((a) of FIG. 9) engages with the rail 105*b*. Thus, a mount locus of the unit 11 is regulated. Further, when the unit 11 is moved in the mounting direction Y1, the pin 117 engages with the hole 1041 and the pin 118 engages with the hole 1031. As a result, the unit 11 is positioned relative to the apparatus main assembly 10. Further, as shown in (a) of FIG. 4, when the cover is closed, the image forming operation can be executed as shown in FIG. 1A.

As described above, the cartridge 2 is dropped from above into the grooves 113 and 1151 to be positioned relative to the unit 11. Further, by swinging the holding portion 241, the cartridge 2 is fixed in the unit 11. Further, the unit 11 is moved in the mounting direction Y1, so that the pin 117 is engaged in the hole 1041 to be positioned and the pin 118 is engaged in the hole 1031 to be positioned. That is, without using particularly complicated constitution, the cartridge 2 is positioned relative to the apparatus main assembly 10.

Further, as shown in (b) of FIG. 9, inside the apparatus main assembly 10, the moving mechanism (developing cartridge moving means) 12 for moving the cartridge 3, in the direction perpendicular to the shaft of the photosensitive drum 21, to the developing position E1 and the retracted position E2 is disposed. The moving mechanism 12 moves the cartridge 3 to the developing position E1 (FIG. 1A) in the case where the developing roller 31 develops the electrostatic latent image on the surface of the photosensitive drum 21. Further, the moving mechanism 12 retracts the cartridge 3 from the cartridge 2 and moves the cartridge 3 to the retracted position E2 when mounting and demounting of the cartridge 2 and the cartridge 3 are performed. In the case where the cartridge is mounted and demounted, the unit 11 is moved between the first position D1 and the second position D2. The developing position E1 is shown in FIG. 1A, and the retracted position E2 is shown in FIG. 1B and (a) and (b) of FIG. 5. The first position D1 is shown in (b) of FIG. 4, and the second position D2 is shown in (a) of FIG. 6.

The moving mechanism 12 includes a shaft 122 (swing center shaft) rotatably supported at end portions by the apparatus main assembly 10 and an arm 121 (swing arm) attached to the shaft 121 to an end portion. The shaft 122 is provided so as to extend in the direction along the shaft 211. Further, the arm 121 is provided so as to extend in the direction along the surface of the wall 104. Further, in the apparatus main assembly 10, a developing cartridge guide 106 for guiding mount of the cartridge 3 at a lower side is provided. The guide 106 is used for mounting the cartridge 3 to the moving mechanism 12 and demounting the cartridge 3 from the moving mechanism 12. When the cartridge 3 is mounted to and demounted from the apparatus main assembly 10, the frame 35 ((a) of FIG. 3) engages with the guide 106, so that the mount locus of the cartridge 3 is regulated.

FIG. 10 is a perspective view showing a state in which the moving mechanism 12 sectional views the cartridge 3K. In FIG. 10, the cartridge 3K includes the frame 35, an engaging portion 352 at the pulling-out direction Y2 side, and an engaging portion 351 at the mounting direction Y1 side. Further, the cartridge 3K includes the accommodating portion 32, the shaft 311 and the developing roller 31 rotatable about the shaft 311.

On the other hand, the moving mechanism 12 provided in the apparatus main assembly 10 includes the shaft 122, the arm 121 and a portion to be engaged 123. The arm 121 is attached at a rear end portion side of the shaft 122 with respect to the mounting direction Y1. The portion to be engaged 123 is disposed at a front end portion side of the shaft 122 with respect to the pulling-out direction Y2 and is engaged with the engaging portion 352. The arm 121 is provided, at its longitudinal central portion, a (rear-side) portion to be engaged 1213 to be engaged with the engaging portion 351. The arm 121 is provided, at its one engaging portion, an engaging hole 122*a* in which the shaft 122 is engaged, and is provided, at the other end portion, a (developing) coupling 1211 engaged with the shaft 311.

When the cartridge 3K is mounted in the apparatus main assembly 10, the shaft 311 engages with the coupling 1211 rotatably supported by the arm 121. The coupling 1211 is provided with a (developing device driving) shaft 1212 connected to a driving means (not shown) at a side opposite from the developing roller 31 side. When the shaft 1212 is rotated, a rotational force is transmitted via the coupling 1211, so that the developing roller 31 is rotated. Further, to the portion to be engaged 1213, the engaging portion 351 provided to the cartridge 3 is engaged. On the other hand, the arm 121 is swingably supported about the shaft 122, and the shaft 122 is rotatably supported. Further, at the side of the shaft 122 with respect to the pulling-out direction Y2, the portion to be engaged 123 is provided and engages with the engaging portion 352 of the cartridge 3. The portion to be engaged 123 is rotatably supported together with the shaft 122.

Thus, the cartridge 3K is supported by the moving mechanism 12. Then, when the shaft 122 is rotationally moved, the cartridge 3 swings about the shaft 122. When the image forming apparatus 1 executes the image forming process, the moving mechanism 12 moves the developing roller 31 to the developing position E1 as shown in FIG. 1A. Further, when the process is changed from the image forming process to the collecting process, the shaft 122 rotates counterclockwise (FIG. 1A). Then, the moving mechanism 12 moves the cartridge 3 to the retracted position E2 in which the developing roller 31 and the photosensitive drum 21 are separated from each other (FIG. 1A).

Incidentally, when the image forming apparatus 1 forms the full-color image, the four developing rollers 31Y, 31M, 31C and 31K have been moved to the developing portion E1 (FIG. 1A). However, when the monochromatic image is formed, the developing roller 31K is moved to the developing position E1 and other developing rollers 31Y, 31M and 31C may be moved to the retracted position E2. Thus, when the monochromatic image is formed, it is possible to prevent abrasion (wearing) of the cartridges 3Y, 3M and 3C.

Further, in this embodiment, in the case where the developing roller 31 of the contact type is used, when the photosensitive drum 21 and the developing roller 31 are left standing for a long term while being contacted to each other, there is a possibility of formation of contact marks. There is a possibility that these contact marks appear on the image. Therefore, at the time other than during the execution of the image forming process, the developing roller 31 may also be moved to the retracted position E2.

Part (a) of FIG. 11 is a partly enlarged view of the moving mechanism 12 at the rear side. In (a) of FIG. 11, the arm 121 is indicated by a chain double-dashed line and a state in which the cover 101 is open is shown.

As shown in (a) of FIG. 11, the shaft 122 is provided with a gear 1221 (rotational mount gear) capable of rotationally moving the shaft 122. The gear 1221 is provided with an arm spring (elastic member) 1222 for urging the arm 121 in one direction. The spring 1222 urges the arm 121 counterclockwise.

A shaft 124 (drive input shaft) is connected to a driving source (not shown) and drives a gear 1241 (drive input gear). A plate 125 (cam plate) is supported swingably about the shaft 124 as a center shaft (axis). The plate 125 is provided with a gear 1251 (idler gear) for transmitting the driving force from the gear 125 to the gear 1221. The plate 125 is further provided with a hole 1251 (cam hole) engaged with a pin 1262 (cam rod pin).

A rod 126 (cam rod) is supported movably in an arrow X1 direction and an arrow X2 direction and is urged in the arrow X1 direction by an urging member (urging means, not shown). Further, the rod 126 is provided with the pin 1262 engaged with the hole 1252.

A rod 127 (cover rod) is supported movably in the mounting direction Y1 and the pulling-out direction Y2 and is urged in the pulling-out direction Y2 by an urging member (urging means, not shown). Further, the rod 127 is moved, in interrelation with the opening and closing operation of the cover 101, in the mounting direction Y1 and the pulling-out direction Y2. When the cover 101 is closed, the rod 127 is pushed into the mounting direction Y1 by an engaging portion (not shown), and when the cover 101 is open, the rod 127 is moved in the pulling-out direction Y2 by the urging member.

When the cover 101 is in the open state, the rod 127 is in a state in which the rod 127 is moved in the pulling-out direction Y2 by the urging member. At this time, the rod 126 is in a state in which the rod 126 is moved in the arrow X1 direction by the urging member. Further, at this time, the gears 1251 and 1221 are separated from each other. Therefore, the arm 121 is in a swung state (in the counterclockwise direction in (a) of FIG. 11) by the action of the spring 1222 (arm spring). Therefore, the cartridge 3 is in a state in which the cartridge 3 is supported at the retracted position E2 ((a) and (b) of FIG. 5).

Part (b) of FIG. 11 is a partly enlarged view of the moving mechanism 12 at the rear side. In (b) of FIG. 11, the arm 121 is indicated by the chain double-dashed line and a state in which the cover 101 is closed is shown. When the cover 101 is closed, as shown in (b) of FIG. 11, the rod 127 is moved in the mounting direction Y1. At this time, an inclined surface 1271 provided at an end of the rod 127 contacts an inclined surface 1261 provided at an end of the rod 126. With continuous mount of the rod 127 in the mounting direction Y1, the rod 126 is moved in the arrow X2 direction. With this operation, the pin 1262 provided to the rod 126 is moved in the arrow X2 direction.

The pin 1262 engages with the hole 1252 provided in the plate 125. The plate 125 is supported swingably about the shaft 124. Therefore, the plate 125 swings (in the counterclockwise direction in (a) of FIG. 11).

Further, the plate 125 is provided with the gear 1251. For that reason, the gear 1251 swings (in the counterclockwise direction in FIG. 1A). Then, the gears 1251 and 1221 contact each other. At this time, the gears 1241, 1251 and 1221 are placed in a state in which the driving force is transmittable. Therefore, when the shaft 124 is driven by a predetermined amount, the arm 121 swings together with the shaft 122, so that the cartridge 3 can be moved to the developing position E1 (FIG. 1A).

When the cover 101 is opened again, a reverse operation from the above-described operation is performed, so that the moving mechanism 12 is placed in the state shown in (a) of FIG. 11. That is, according to the constitution in this embodiment, even in the case where the cartridge 3 is located at any position other than the retracted position E2, when the cover 101 is opened, the cartridge 3 can be moved to the retracted position E2 ((a) and (b) of FIG. 5).

Interrelating means such as the gear 1221, the spring 1222, the shaft 124, the gear 1241, the plate 125, the gear 1251 and the hole 1252 are provided to each of the moving mechanisms 12 for all of the cartridges 3. Further, the rod 126 is extended further in the arrow X2 direction from the portion as shown in (a) of FIG. 11. The pin 1262 can swing all the plates 125.

Next, an exchanging (replacing) method of the cartridge 3K will be described. First, the user moves the cover 101 from the closed state ((a) of FIG. 4) to the open state ((b) of FIG. 4). When the cover 101 is opened, the moving mechanism 12 moves each cartridge 3 to the retracted position E2 ((a) and (b) of FIG. 15). Each cartridge 3 is supported by the moving mechanism 12 when the cartridge 3 is located inside the apparatus main assembly 10. At this time, the cartridge 3K is supported in such a manner that the shaft 311, the engaging portion 351 and the engaging portion 352 are supported by the coupling 1211, the portion to be engaged 1213 and the portion to be engaged 123, respectively (FIG. 10). The coupling 1211 and the portions to be engaged 1231 and 123 are holes which open toward the pulling-out direction Y2 of the cartridge 3. For that reason, the cartridge 3 is movable in the pulling-out direction Y2. The user pulls out the cartridge 3K, moved to the retracted position E2, in the pulling-out direction Y2, thus demounting the cartridge 3K from the moving mechanism 12. The user pulls out the cartridge 3K along the gear 106 ((b) of FIG. 9 and FIG. 12).

FIG. 12 is a perspective view showing the structure of the pulled-out cartridge 3K and the apparatus main assembly 10. As shown in FIG. 12, when the cover 101 is opened, the moving mechanism 12 ((b) of FIG. 9) is moved to the retracted position E2 ((a) and (b) of FIG. 5). The user holds the holding portion 353 of the cartridge 3K and can pull out the cartridge 3 in the pulling-out direction Y2. In the case where the cartridge 3K is mounted in the apparatus main assembly 10, the reverse of these operation may be made.

As described above, the cartridge 2 is pulled out to the outside of the apparatus main assembly 10 in a state in which the cartridge 2 is supported by the unit 11, and thereafter is detachably mountable from above the unit 11. Therefore, the positioning of each cartridge 2 can be effected in a simple constitution.

Further, when the cover 101 is opened, all the cartridges 3 are moved to the retracted position E2 by the moving mechanism 12 ((b) of FIG. 9). That is, when the cover 101 is opened, the unit 11 and the respective cartridges 3 are detachably mountable independently and irrespective of the order of mounting and demounting. In other words, each cartridge 3 can be independently mountable to and demountable from the apparatus main assembly 10 even when any cartridge 3 is selected.

Further, as described in this embodiment, when the image forming process is executed, the residual developer generated from each cartridge is collected by the common cartridge 6. That is, compared with a constitution in which each cartridge 2 is provided with a residual developer collecting portion, each cartridge 2 can be downsized. Therefore, it is possible to reduce a load when the unit 11 is moved.

Embodiment 2

Part (a) of FIG. 13 is a perspective view showing a structure of an image forming apparatus 200 in this embodiment. Part (a) of FIG. 13 shows a state in which the cover 101 is opened and the cartridge 3K is pulled out from the apparatus main assembly 10 in the pulled-out direction Y2. In this embodiment, with respect to the same constitution and effect as those of the image forming apparatus 1 in Embodiment 1, the description will be appropriately omitted by using the same reference numerals or symbols. A difference of the image forming apparatus 200 in this embodiment from the image forming apparatus 1 in Embodiment 1 is as follows.

First, the image forming apparatus 200 includes a drum cartridge supporting unit (member) 511 in place of the unit 11. The unit 511 is provided with a developing roller guide groove (means) 16 for guiding the developing roller 31 toward the photosensitive drum 21 when each cartridge 3 is moved to the developing position E1. In this embodiment, as shown in FIG. 16, the guide groove 16 guides the developing roller 31 toward the photosensitive drum 21 when the cartridge 3 is moved from an intermediate position E3 to the developing position E1. However, the guide groove 16 is not necessarily required to guide the developing roller 31 from the intermediate position E3 toward the photosensitive drum 21. At the intermediate position, the developing roller 31 is not moved largely from the photosensitive drum 21 move than the case of the retracted position E2 and is spaced from the photosensitive drum 21 to the extent that the developing roller 31 does not constitute a hindrance to the operation during the collecting process, during the monochromatic image formation and during the stop of the image forming apparatus 200. Incidentally, in the case of the monochromatic image formation, the cartridge 3 located at the intermediate position E3 is limited to the cartridges 3Y, 3M and 3C. Further, in the case where the unit 11 and the cartridges 3 are mounted and demounted, a constitution in which the arm 151 (swing arm) is retracted from the frame 35, as a basis of the mounting and demounting locus, to the retracted position E2 is assumed. In this case, there is a need to set an amount of mount of the arm 151 at a large value. The above constitution obviates this necessity.

Further, a developing cartridge moving mechanism 15 is attached to the unit 511 ((a) and (b) of FIG. 11). This is different from Embodiment 1 in which the moving mechanism 12 is attached to the apparatus main assembly 10. Incidentally, the intermediate position E3 is not always required to be located at a middle of the distance between the developing position E1 and the retracted position E2 but may also be located at any position between the positions E1 and E2. In the case where the developing roller 31 is used for development, the cartridge 3 is moved to the developing position E1. In the case where the developing roller 31 is not used for development and in the case where the mount of the unit 511 or the mounting and demounting of the cartridge 3 is not effected, the cartridge 3 is moved to the intermediate position E3. In the case where the developing roller 31 is not used for development and in the case where the mount of the unit 511 or the mounting and demounting of the cartridge 3 is effected, the cartridge 3 is moved to the retracted position E2. With respect to the mount of the cartridge 3 by the moving mechanism 15 to the intermediary position E3 in addition to the developing position E1 and the retracted position E2, the moving mechanism 12 used in Embodiment 1 or Embodiment 3 described later may also be applied.

As shown in (a) of FIG. 13, the cartridge 3K has the shaft 311 protruded from the longitudinal ends of the frame 35.

Part (b) of FIG. 13 is a side view showing the structure of the image forming apparatus 200 and shows a state in which the cover 101 is opened. As shown in FIG. 13, when the cover 101 is opened, the cartridge 3 moves to the retracted position E2. Further, the unit 511 is provided with the moving mechanism 15 and a guide groove 16.

Part (a) of FIG. 14 is a perspective view showing the structure of the apparatus main assembly 10. In (a) of FIG. 14, in order to facilitate explanation of a portion where the unit 511 and the cartridges 3 are mounted and demounted at the inside of the apparatus main assembly 10. An outer appearance of the image forming apparatus 200 is indicated by the chain double-dashed line. As shown in (a) of FIG. 14, the cover 101 is provided with front-side developing cartridge guides 1011 and is provided with guides 106 inside the opening 102 provided in the wall 103. The wall 104 is provided with rear-side developing cartridge guides 1042 which are provided with engaging portions 1043 (drive input shaft engaging portions). When the cover 101 is closed, the gears 1011 and 1042 are opposed to each other.

Part (b) of FIG. 14 is a perspective view showing the structure of the unit 511. As shown in (b) of FIG. 14, the unit 511 includes the moving mechanisms 15. The unit 511 is provided with the side plates 111 and 112 which are provided with the guide grooves 16 at a lower side. Each moving mechanism 15 includes the arms 151 provided outside the side plates 111 and 112, the swing shaft 152 for swinging each arm 151, and an engaging portion 1521 engaged with the engaging portion 1043 (FIG. 15). When the unit 511 is mounted in the apparatus main assembly 10, the engaging portions 1521 and 1043 engage with each other. To the engaging portion 1043, the driving force is inputted from the driving source (not shown) so that the arm 151 is swung.

Part (a) of FIG. 15 is a partly enlarged view showing the structure of the moving mechanism 15. In the case of (a) of FIG. 15, the cartridge 3K is disposed at the retracted position E2. Part (a) of FIG. 15 shows a state in which the unit 511 and the cartridge 3K are mounted in the apparatus main assembly 10. In this embodiment, only the side of the side plate 122 of the moving mechanism 15 will be described but the side of the side plate 111 has the same constitution as that at the side of the side plate 112. For this reason, the description at the side plate 112 side is also applicable to the side plate 111 side. As shown in (a) of FIG. 15, when the unit 511 is mounted in the apparatus main assembly 10, the engaging portions 1521 and 1043 engage with each other. Further, when the cartridge 3 is mounted in the apparatus main assembly 10, the end of the shaft 311 is guided by the guide 106 and enters the guide 1042.

Part (b) of FIG. 15 is a partly enlarged perspective view showing the structure of the moving mechanism 15 and shows a state in which the cartridge 3K is disposed at the developing position E1. When the arm 151 is swung in the state shown (a) of FIG. 15, as shown in (b) of FIG. 15, the arm 151 contacts the shaft 311. Further, when the arm 151 is swung in this state, the arm 151 is moved to the developing position E1.

Incidentally, into the engaging portion 1043, the cam mechanism similar to that of the moving mechanism 12 described in Embodiment 1 is incorporated. Therefore, when the cover 101 is opened, the arm 151 is swung to move to the retracted position E2 shown in (a) of FIG. 16.

Parts (a) to (c) of FIG. 16 are enlarged side views for illustrating the operation of the arm 151 in the image forming apparatus 200. Part (a) of FIG. 16 shows a state in which the arm 151 is spaced from the shaft 311 and the cartridge 3K is disposed at the retracted position E2. Part (b) of FIG. 16 shows a state in which the arm 151 contacts the shaft 311 but the cartridge 3K is disposed at the intermediate position E3. Part (c) of FIG. 16 shows a state in which the arm 151 contacts the shaft 311 and the cartridge 3K is disposed at the developing position E1. In these figures, the guide 1011 is indicated by a partly dotted line. In FIG. 16, only the constitution of the front-side arm 151 is illustrated but the rear-side arm has the same constitution, thus being omitted from explanation.

As shown in (a) of FIG. 16, in the case where the arm 151 does not contact the shaft 311, the cartridge 3K is located at the position in which the cartridge 3K is spaced from the unit 511. The cartridge 3K is guided by the guide 106. Therefore, the user opens the cover 101 and pulls out the unit 511 in this state at the front side, so that the cartridge 3K can be demounted from the apparatus main assembly 10. Further, when the cartridge 3K is mounted in the apparatus main assembly 10, the cartridge 3K is inserted along the guide 106 and then the cover 101 may be closed.

The guide 1011 is set to have predetermined play with the shaft 311. This is because, in the case where the cover 101 is opened and closed, there is a possibility that the guide 1011 constitutes a hindrance to the smooth opening and closing operation of the cover 101 when the guide 1011 does not have a clearance with the shaft 311 to some degree.

As shown in (c) of FIG. 16, when the image forming process is executed, the engaging portion 1043 (FIG. 15) is driven by a predetermined amount, so that the arm 151 is swung counterclockwise. Then, the arm 151 engages with the shaft 311. At this time, mount of the shaft 311 is prevented by the guide 1011. Therefore, the cartridge 3K moves along the shape of the guide 1011. When the arm 151 is swung, the shaft 311 engages with the guide groove 16 (developing roller guide groove).

The guide groove 16 is provided to the side plate 111 of the unit 511. A drum shaft groove (positioning portion) 113 for positioning the cartridge 2K is also provided to the side plate 111. Further, the arm 151 is similarly supported swingably by the side plate 111. That is, the guide groove 16 and the arm 151 can ensure high accuracy with respect to the photosensitive drum 21. The shaft 311 is guided by the guide groove 16 and is moved to the developing position E1 by the arm 151. Therefore, the position accuracy between the photosensitive drum 21 and the developing roller 31 can be ensured with high accuracy.

As shown in (b) of FIG. 16, when the collecting process is executed, the engaging portion 1043 (FIG. 15) is driven by a predetermined amount and the arm 151 is swung clockwise, so that the cartridge 3K is moved to the intermediate position E3 between the developing position E1 and the retracted position E2. When the collecting process is executed, there is a need to separate the photosensitive drum 21 and the developing roller 31. However, the amount of separation (spacing) may be any value unless the collecting process is adversely affected, so that there is no need to move the developing roller 31 to the retracted position E2. Particularly, in this embodiment, the guide groove 16 is protruded from the side plate 111 and therefore the amount of mount of the arm 151 is required to be increased in order to move the developing roller 31 to the retracted position E2.

The image forming process and the collecting process are repeated with predetermined timing when the image forming operation is executed. When these processes are switched, it becomes possible to reduce a switching time by decreasing the mount amount of the arm 151. Further, as described above, also with respect to the switching between the full-color image formation and the monochromatic image formation, similarly, the reduction in switching time can be effected.

Thus, the cartridge 3K can be movable to the developing position E1, the retracted position E2 and the intermediate position E3 by the arm 151.

As described above, when the unit 511 for supporting the cartridge 2 is provided with the guide groove 16 for guiding the developing roller 31, it is possible to improve relative positional accuracy between the photosensitive drum 21 and the developing roller 31.

Further, by providing the moving mechanism 15 to the unit 511, the position of the developing roller 31 at the developing position E1 can be ensured relative to the photosensitive drum 21 with high accuracy.

Further, the cartridge 3 is moved to the intermediate position E3 between the developing position E1 and the retracted position E2 during a predetermined process such as the collecting process or the monochromatic image forming process or during the stop of the image formation. As a result, it is possible to reduce the switching time between the image forming process and the collecting process. Incidentally, as described above, the constitution in which the cartridge 3 is moved to the intermediate position E3 is also applicable to the constitution in Embodiment 1. Even in the case where the constitution in this embodiment is applied to the constitution in Embodiment 1, it is possible to realize reduction in switching time between the image forming process and the predetermined process described above.

Embodiment 3

Part (a) of FIG. 17 in a sectional view showing a structure of an image forming apparatus 300 in this embodiment. With respect to the image forming apparatus 300 in this embodiment, the same constitution and effect as those of the image forming apparatus 1 or 200 in Embodiment 1 or 2 are described by using the same reference numerals or symbols and will be omitted from explanation. In the image forming apparatus 1 or 200 in Embodiment 1 or 2, the LED head 4 is provided below each cartridge 2 but in the image forming apparatus 300 in this embodiment, the LED head 4 is provided above each cartridge 2. This is a difference between this embodiment and Embodiment 1 or 2.

As shown in (a) of FIG. 17, above each cartridge 2, the LED head 43 is provided. Corresponding to this, a relative arrangement of each cartridge 3, the transfer portion 5 and the cartridge 6 is changed. Further, similarly as in Embodiment 1 or 2, the cartridge 2 is positioned relative to the unit 11 or 511. Further, each of the cartridges 3 is supported by the moving mechanism 12 or 15. Further, each of the cartridges 3 is movable, similarly as in Embodiment 2, to the developing position E1, the retracted position E2 or the intermediate position E3.

Part (b) of FIG. 17 is front view showing the structure of the image forming apparatus 300 and shows a state in which the cover 101 is opened. As shown in (b) of FIG. 17, when the cover 101 is opened, each cartridge 3 is moved to the retracted position E2 by the moving mechanism 12. At this time, the unit 11 and the respective cartridges 3 are independently detachably mountable.

FIG. 18 is a perspective view showing a structure of an image forming apparatus 400 in which an original reading device 14 is mounted at an upper portion of the apparatus main assembly 10. In such an image forming apparatus 400, when the user mounts and demounts the cartridge 2 from above the apparatus main assembly 10, the original reading device 14 is required to be retracted from above each cartridge 2.

In the constitutions in Embodiments 1 to 3 described above, even in the image forming apparatus having the conventional constitution, when the cover 101 is opened, each cartridge 2 (2Y to 2K) and each cartridge 3 (3Y to 3K) can be mounted and demounted without retracting the original reading device 14 or the like. That is, in the conventional constitution, in order to mount and demount the developing cartridge from above the apparatus main assembly, the primary transfer roller or the drum cartridge was required to be retracted. Further, in the conventional constitution, in order to mount and demount the drum cartridge from above the apparatus main assembly, there was a need to retract the developing cartridge and the LED head. However, in the above-described constitutions in Embodiments 1 to 3, there is no need to retract the developing cartridge and the LED head.

According to the image forming apparatuses in Embodiments 1 to 3, on the precondition that the unit 11 or 511 for supporting the plurality of cartridges 2 and the plurality of cartridges 3 is used, it is possible to image exchange easily the cartridges 3Y to 3K which have a high possibility of individual exchange.

According to the above-described embodiments, in the case where the plurality of cartridges 2 and the plurality of cartridges 3 are mounted and demounted, the individual cartridge 2 is pulled-out and demounted from the unit 11 (511). Then, the individual cartridge 3 can be individually and directly demounted from the apparatus main assembly 10. As a result, in the constitution in which the unit 11 (511) for supporting the plurality of cartridges 2 is provided, it is possible to individually and easily exchange the cartridges 3 which have a high possibility of individual exchange.

According to the present invention, in the case where the plurality of drum cartridges and the plurality of developing cartridges are demounted and mounted, the individual drum cartridges are demounted after the drum cartridge supporting member is pulled out. Then, the individual developing cartridges can be individually and directly demounted from the apparatus main assembly. As a result, on the precondition that the drum cartridge supporting member for supporting the plurality of drum cartridges is used, the developing cartridges which have a high possibility of individual exchange can be individually exchanged easily.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 205269/2010 filed Sep. 14, 2010, which is hereby incorporated by reference.

What is claimed is:

1. An image forming apparatus for forming an image on a recording material, comprising:

a drum cartridge supporting member for supporting a plurality of drum cartridges, each including an electrophotographic photosensitive drum, wherein said drum cartridge supporting member is movable, with respect to an axial direction of the electrophotographic photosensitive drums, between a first position inside a main assembly of said image forming apparatus and a second position, outside the main assembly, in which the drum cartridges are mountable and dismountable;

a guide portion, fixed in the main assembly, for guiding a plurality of developing cartridges, each including a developing roller for developing an electrostatic latent image formed on a corresponding one of the electrophotographic photosensitive drums, wherein said guide portion individually guides the developing cartridges mountably to and demountably from the main assembly in an axial direction of the developing rollers; and moving means for moving the developing cartridges mounted in the main assembly between a developing position in which the electrostatic latent image is to be developed and a retracted position in which the developing cartridges are retracted from the developing position, wherein when the developing cartridges are in the retracted position, said drum cartridge supporting member is permitted to move between the first position and the second position, wherein when the developing cartridges are mounted in the main assembly, said moving means is engaged with the developing cartridges, wherein said moving means includes an arm provided movably in the main assembly and a drive transmission member, rotatably supported by the arm, for transmitting a driving force to the developing rollers, and wherein the drive transmission member is a coupling engaged with shafts of the developing rollers when the developing cartridges are mounted in the main assembly.

2. An apparatus according to claim 1, further comprising:

an opening through which the drum cartridges and the developing cartridges are mountable to and demountable from the main assembly;

a cover for opening and closing said opening; and interrelating means for interrelating said cover with said moving means, wherein said interrelating means acts on said moving means so that the developing cartridges are moved to the retracted position when the cover is opened and are moved to the developing position when the cover is closed.

3. An apparatus according to claim 1, wherein said drum cartridge supporting member includes a developing roller guide for guiding the developing rollers toward the photosensitive drums to position the developing rollers relative to the photosensitive drums when said moving means moves the developing cartridges to the developing position.

4. An apparatus according to claim 1, wherein said moving means is mounted on said drum cartridge supporting member.

5. An apparatus according to claim 1, wherein said moving means moves, when said drum cartridge supporting member is not moved between the first position and the second position and the developing cartridges do not develop the electrostatic latent image, the developing cartridges to an intermediate position in which the developing rollers are closer to the photosensitive drums than when the developing cartridges are in the retracted position.

6. An apparatus according to claim 1, wherein said drum cartridge supporting member includes a cartridge positioning portion for positioning the drum cartridges.

7. An apparatus according to claim 1, wherein said moving means is individually provided for the plurality of developing cartridges.

8. An apparatus according to claim 1, wherein the plurality of developing cartridges contain developers of different colors, respectively.

* * * * *